US009659543B2

(12) United States Patent
Nakano

(10) Patent No.: US 9,659,543 B2
(45) Date of Patent: May 23, 2017

(54) METHOD OF DRIVING LIQUID CRYSTAL DISPLAY DEVICE DURING WRITE PERIOD

(71) Applicant: Sharp Kabushiki Kaisha, Osaka-shi, Osaka (JP)

(72) Inventor: Fumiki Nakano, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 14/402,177

(22) PCT Filed: Apr. 15, 2013

(86) PCT No.: PCT/JP2013/061171
§ 371 (c)(1),
(2) Date: Nov. 19, 2014

(87) PCT Pub. No.: WO2013/179787
PCT Pub. Date: Dec. 5, 2013

(65) Prior Publication Data

US 2015/0170599 A1 Jun. 18, 2015

(30) Foreign Application Priority Data

Jun. 1, 2012 (JP) ..... 2012-126546

(51) Int. Cl.
*G09G 3/36* (2006.01)

(52) U.S. Cl.
CPC ..... *G09G 3/3696* (2013.01); *G09G 3/3614* (2013.01); *G09G 3/3618* (2013.01); *G09G 3/3655* (2013.01); *G09G 3/3674* (2013.01); *G09G 2300/0426* (2013.01); *G09G 2320/0219* (2013.01); *G09G 2320/0247* (2013.01);
(Continued)

(58) Field of Classification Search
CPC ..... G09G 3/36; G09G 3/3614; G09G 3/3655; G09G 3/3659; G09G 3/3611; G09G 3/3622; G09G 3/3625; G09G 3/364; G09G 3/3666; G09G 3/3996
USPC ..... 345/87–104
See application file for complete search history.

(56) References Cited

U.S. PATENT DOCUMENTS 9,293,103 B2 * 3/2016 Saitoh ..... G09G 3/3614
9,478,186 B2 * 10/2016 Nakata ..... G09G 3/3614
2002/0180673 A1 12/2002 Tsuda et al.
(Continued)

FOREIGN PATENT DOCUMENTS

JP 2008-233925 A 10/2008

*Primary Examiner* — Alexander Eisen
*Assistant Examiner* — Nelson Lam
(74) *Attorney, Agent, or Firm* — Keating & Bennett, LLP

(57) ABSTRACT

There are provided a method of driving a liquid crystal display device, a liquid crystal display device, and a portable device including the liquid crystal display device that can display an image where the occurrence of flicker is restrained when pause driving is performed. In a positive polarity pixel, a voltage of a counter electrode applied during a write period T1 is set to be higher than a counter voltage applied during a pause period T2 and is brought back to its original reference value immediately before starting the pause period T2. In this case, in the positive polarity pixel, the voltage applied to the liquid crystal layer decreases by an amount corresponding to the increase in the voltage of the counter electrode during the write period T1, compared to a negative polarity pixel, and thus, the change in luminance over time decreases.

11 Claims, 19 Drawing Sheets

(52) U.S. Cl.
CPC ..... *G09G 2320/0626* (2013.01); *G09G 2330/021* (2013.01); *G09G 2340/0435* (2013.01)

(56) References Cited

U.S. PATENT DOCUMENTS

| | | | | |
|---|---|---|---|---|
| 2003/0080932 | A1* | 5/2003 | Konno | G09G 3/3648 345/96 |
| 2008/0239180 | A1* | 10/2008 | Sekine | G09G 3/3611 349/37 |
| 2008/0266217 | A1* | 10/2008 | Kim | G09G 3/3655 345/87 |
| 2010/0271359 | A1* | 10/2010 | Takeuchi | G09G 3/3655 345/209 |
| 2011/0090184 | A1* | 4/2011 | Yamazaki | G09G 3/20 345/204 |
| 2011/0169788 | A1* | 7/2011 | Abe | G09G 3/3655 345/204 |
| 2011/0181501 | A1* | 7/2011 | Wei | G09G 3/3655 345/87 |
| 2013/0222359 | A1* | 8/2013 | Nakata | G09G 3/3614 345/212 |
| 2014/0028646 | A1* | 1/2014 | Saitoh | G09G 3/3614 345/209 |
| 2014/0125569 | A1* | 5/2014 | Nakata | G09G 3/3648 345/87 |

* cited by examiner (a)

Fig. 11

(a)

| | | | |
|---|---|---|---|
| + | + | + | + |
| − | − | − | − |
| + | + | + | + |
| − | − | − | − |

+ ---- POSITIVE POLARITY PIXEL

− ---- NEGATIVE POLARITY PIXEL (b)

| | | | |
|---|---|---|---|
| − | − | − | − |
| + | + | + | + |
| − | − | − | − |
| + | + | + | + |

+ ---- POSITIVE POLARITY PIXEL

− ---- NEGATIVE POLARITY PIXEL

Fig. 15

(a)

| | | | |
|---|---|---|---|
| + | − | + | − |
| + | − | + | − |
| + | − | + | − |
| + | − | + | − |

+ ---- POSITIVE POLARITY PIXEL

− ---- NEGATIVE POLARITY PIXEL (b)

| | | | |
|---|---|---|---|
| − | + | − | + |
| − | + | − | + |
| − | + | − | + |
| − | + | − | + |

+ ---- POSITIVE POLARITY PIXEL

− ---- NEGATIVE POLARITY PIXEL

Fig. 19

(a)

| | | | |
|---|---|---|---|
| + | − | + | − |
| − | + | − | + |
| + | − | + | − |
| − | + | − | + |

+ ---- POSITIVE POLARITY PIXEL

− ---- NEGATIVE POLARITY PIXEL (b)

| | | | |
|---|---|---|---|
| − | + | − | + |
| + | − | + | − |
| − | + | − | + |
| + | − | + | − |

+ ---- POSITIVE POLARITY PIXEL

− ---- NEGATIVE POLARITY PIXEL

METHOD OF DRIVING LIQUID CRYSTAL DISPLAY DEVICE DURING WRITE PERIOD

TECHNICAL FIELD

The present invention relates to a method of driving a display device, a display device, and a portable device including the display device. More particularly, the present invention relates to a method of driving a display device, a display device, and a portable device including the display device that displays images by pause driving.

BACKGROUND ART

In recent years, a display device has started to be used that performs pause driving (also called low frequency driving or intermittent driving) where driving is performed at a frame frequency lower than 60 Hz which is normally used, to achieve a reduction in power consumption when displaying an image with small changes such as a still image.

To achieve an improvement in image quality during such pause driving, Japanese Patent Application Laid-Open No. 2008-233925 discloses that the voltages of data signal lines and a counter electrode of a liquid crystal panel applied during a pause period are set to be substantially equal to the central voltages of their respective voltage amplitudes applied during a scanning period, by which effective voltages applied to a liquid crystal layer during the scanning period and the pause period are made substantially equal to each other.

PRIOR ART DOCUMENT

Patent Document

[Patent Document 1] Japanese Patent Application Laid-Open No. 2008-233925

SUMMARY OF THE INVENTION

Problems to be Solved by the Invention

However, in the liquid crystal display device described in Japanese Patent Application Laid-Open No. 2008-233925, if the frame frequency is reduced to perform pause driving, when the voltage of an image signal provided to a pixel electrode is higher than a counter voltage applied to the counter electrode, the change in luminance over time increases compared to when the voltage of the image signal is lower than the counter voltage. Hence, there is a problem that flicker occurs in an image displayed when the liquid crystal display device performs pause driving.

An object of the present invention is therefore to provide a method of driving a display device, a display device, and a portable device including the display device that can display an image where the occurrence of flicker is restrained when pause driving is performed.

Means for Solving the Problems

According to a first aspect of the present invention, there is provided a method of driving a display device, including: a plurality of scanning signal lines and a plurality of data signal lines intersecting the plurality of scanning signal lines; a plurality of pixel formation portions disposed in a matrix form at respective intersections of the plurality of scanning signal lines and the plurality of data signal lines; a scanning signal line drive circuit that selects in turn the plurality of scanning signal lines; and a data signal line drive circuit that applies signal voltages of image signals to the plurality of data signal lines to write the signal voltages to pixel formation portions connected to a selected scanning signal line, wherein each of the pixel formation portions includes: a pixel electrode to which a corresponding one of the signal voltages is applied; a counter electrode to which a counter voltage is applied, the counter electrode being provided so as to face the pixel electrode; a switching element that provides the signal voltage to the pixel electrode connected to the selected scanning signal line; and a holding capacitance that holds a drive voltage determined by the signal voltage applied to the pixel electrode and the counter voltage applied to the counter electrode, the signal voltage includes a positive signal voltage and a negative signal voltage, there are provided a write period during which all of the scanning signal lines are selected in turn and one of the positive signal voltage and the negative signal voltage is applied to the pixel electrodes of all of the pixel formation portions, and a pause period during which all of the scanning signal lines are placed in a non-selected state, the pause period following the write period and being longer than the write period, at start of the write period, a first voltage is applied to the counter electrodes of the pixel formation portions to which the positive signal voltage is to be written, the first voltage having a value higher than the counter voltage applied during the pause period, and at end of the write period, a second voltage is applied to the counter electrodes of the pixel formation portions to which the positive signal voltage has been written, the second voltage having a same value as the counter voltage applied during the pause period.

According to a second aspect of the present invention, in the first aspect of the present invention, wherein during the write period, the second voltage is applied to the counter electrodes of the pixel formation portions to which the negative signal voltage is to be written.

According to a third aspect of the present invention, in the first or second aspect of the present invention, further comprising first and second counter electrode drive signal lines for respectively applying the first and second voltages to the counter electrodes of the pixel formation portions, wherein the first voltage is applied to counter electrodes of some of the plurality of pixel formation portions through the first counter electrode drive signal line, and the second voltage is applied to counter electrodes of other pixel formation portions through the second counter electrode drive signal line.

According to a fourth aspect of the present invention, in the third aspect of the present invention, wherein the counter electrodes are connected to each other by one of the first and second counter electrode drive signal lines on a per plurality of pixel formation portions basis, the plurality of pixel formation portions being formed in parallel to the scanning signal lines and being disposed in a same direction as the scanning signal lines.

According to a fifth aspect of the present invention, in the third aspect of the present invention, wherein the counter electrodes are connected to each other by one of the first and second counter electrode drive signal lines on a per plurality of pixel formation portions basis, the plurality of pixel formation portions being formed in parallel to the data signal lines and being disposed in a same direction as the data signal lines.

According to a sixth aspect of the present invention, in the third aspect of the present invention, wherein counter electrodes included in one of a group of pixel formation portions disposed in an odd-numbered row and an odd-numbered column and in an even-numbered row and an even-numbered column and a group of pixel formation portions disposed in an odd-numbered row and an even-numbered column and in an even-numbered row and an odd-numbered column among the pixel formation portions disposed in a matrix form are connected to each other by the first counter electrode drive signal line, and counter electrodes included in an other group of pixel formation portions are connected to each other by the second counter electrode drive signal line.

According to a seventh aspect of the present invention, in the first aspect of the present invention, wherein the switching element is a thin film transistor using an oxide semiconductor as a channel layer.

According to an eighth aspect of the present invention, in the first aspect of the present invention, wherein the switching element is a thin film transistor using polycrystalline silicon as a channel layer.

According to a ninth aspect of the present invention, in the first aspect of the present invention, wherein the switching element is a thin film transistor using amorphous silicon as a channel layer.

According to a tenth aspect of the present invention, in the first aspect of the present invention, wherein one frame period including a set of the write period and the pause period is a period longer than 1/60 seconds.

According to an eleventh aspect of the present invention, there is provided a display device, including: a counter electrode drive circuit that outputs the first and second voltages to the first and second counter electrode drive signal lines, respectively, to perform the method of driving a display device according to any one of the first to ninth aspects of the invention.

According to a twelfth aspect of the present invention, there is provided a portable device, including: the display device according to the eleventh aspect of the invention mounted thereon.

Effects of the Invention

According to the first aspect, at the start of a write period, a first voltage having a value higher than a counter voltage applied during a pause period is applied to a counter electrode of a pixel formation portion to which a positive signal voltage is to be written. By this, a drive voltage held in a holding capacitance of the pixel formation portion to which the positive signal voltage has been written decreases. As a result, the change over time in the luminance of the pixel formation portion to which the positive signal voltage has been written decreases, restraining the occurrence of flicker.

According to the second aspect, at the end of the write period, a second voltage having the same value as the counter voltage applied during the pause period is applied to the counter electrode of the pixel formation portion to which the positive signal voltage has been written. By this, during the pause period, drive voltages held in the holding capacitances of the pixel formation portion to which the positive signal voltage has been written and of a pixel formation portion to which a negative signal voltage has been written become equal to each other, further restraining the occurrence of flicker.

According to the third aspect, the first voltage is applied to counter electrodes of some of a plurality of pixel formation portions through a first counter electrode drive signal line, and the second voltage is applied to counter electrodes of other pixel formation portions. By this, in all of the pixel formation portions of a display device that performs AC driving, the change in luminance over time during the pause period decreases, restraining the occurrence of flicker.

According to the fourth aspect, in a display device that performs line-reversal driving, the change in luminance over time during the pause period decreases, restraining the occurrence of flicker.

According to the fifth aspect, in a display device that performs column-reversal driving, the change in luminance over time during the pause period decreases, restraining the occurrence of flicker.

According to the sixth aspect, in a display device that performs dot-reversal driving, the change in luminance over time during the pause period decreases, restraining the occurrence of flicker.

According to the seventh aspect, in a thin film transistor having a channel layer formed of an oxide semiconductor, off-leakage current decreases. By using such a thin film transistor as a switching element, a holding capacitance can hold a signal voltage of an image signal over an extended period of time. By this, the display device can display an image where flicker is restrained over an extended period of time.

According to the eighth aspect, in a thin film transistor having a channel layer formed of polycrystalline silicon, the on-current increases. By using such a thin film transistor as a switching element, the switching element can be miniaturized. Accordingly, a display device with small pixel formation portions and high definition can be implemented and pause driving can be performed in such a display device with high definition.

According to the ninth aspect, in a thin film transistor having a channel layer formed of amorphous silicon, manufacturing cost can be reduced. By using such a thin film transistor as a switching element, pause driving can be performed by a low-cost display device.

According to the tenth aspect, by setting one frame period to be longer than 1/60 seconds, an image where the occurrence of flicker is effectively restrained can be displayed with low power consumption.

According to the eleventh aspect, since a display device includes a counter electrode drive circuit for applying first and second voltages to first and second counter electrode drive signal lines, respectively, the display device can display an image where the occurrence of flicker is restrained.

According to the twelfth aspect, by mounting a display device capable of achieving a reduction in power consumption while maintaining excellent display quality with no flicker, a portable device can perform long hours driving.

BRIEF DESCRIPTION OF THE DRAWINGS

FIG. 11(*a*) is a diagram showing the locations of positive polarity pixels and negative polarity pixels for when the liquid crystal panel shown in FIG. 8 performs line-reversal driving during odd-numbered frame periods, and FIG. 11(*b*) is a diagram showing the locations of positive polarity pixels and negative polarity pixels for when the liquid crystal panel shown in FIG. 8 performs line-reversal driving during even-numbered frame periods.

FIG. 15(*a*) is a diagram showing the locations of positive polarity pixels and negative polarity pixels for when the liquid crystal panel shown in FIG. 12 performs column-reversal driving during odd-numbered frame periods, and FIG. 15(*b*) is a diagram showing the locations of positive polarity pixels and negative polarity pixels for when the liquid crystal panel shown in FIG. 12 performs column-reversal driving during even-numbered frame periods.

FIG. 19(*a*) is a diagram showing the locations of positive polarity pixels and negative polarity pixels for when the liquid crystal panel shown in FIG. 16 performs dot-reversal driving during odd-numbered frame periods, and FIG. 19(*b*) is a diagram showing the locations of positive polarity pixels and negative polarity pixels for when the liquid crystal panel shown in FIG. 16 performs dot-reversal driving during even-numbered frame periods.

MODES FOR CARRYING OUT THE INVENTION

1. Basic Consideration

Figure 1:
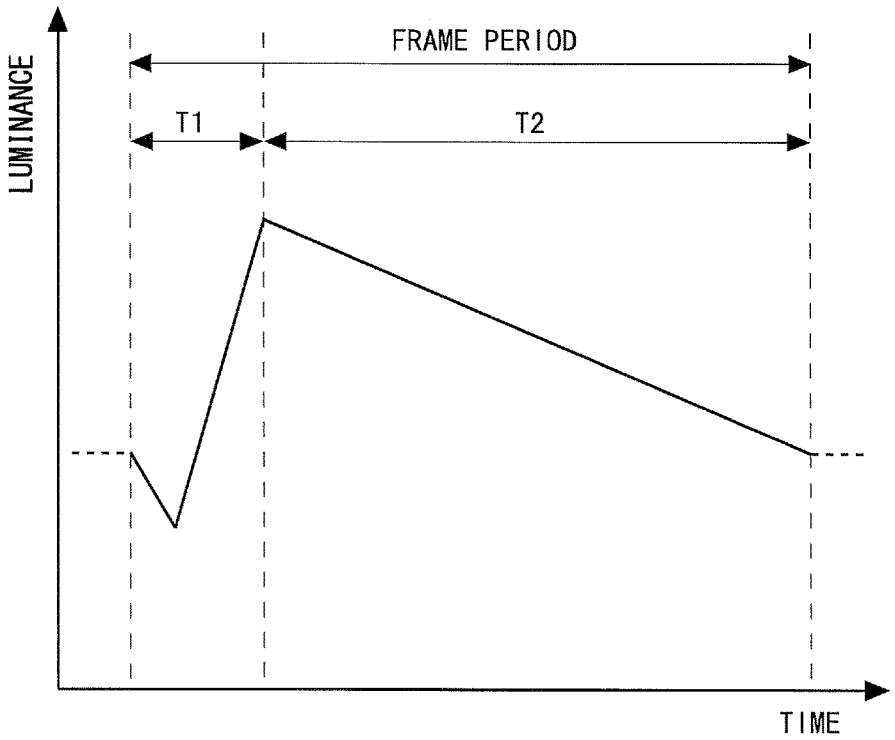
FIG. 1(*a*) is a diagram showing the change over time in the luminance of a positive polarity pixel of a conventional liquid crystal display device during one frame period, and FIG. 1(*b*) is a diagram showing a counter voltage of the liquid crystal display device shown in FIG. 1(*a*) applied during a write period and a pause period.
Figure 1:
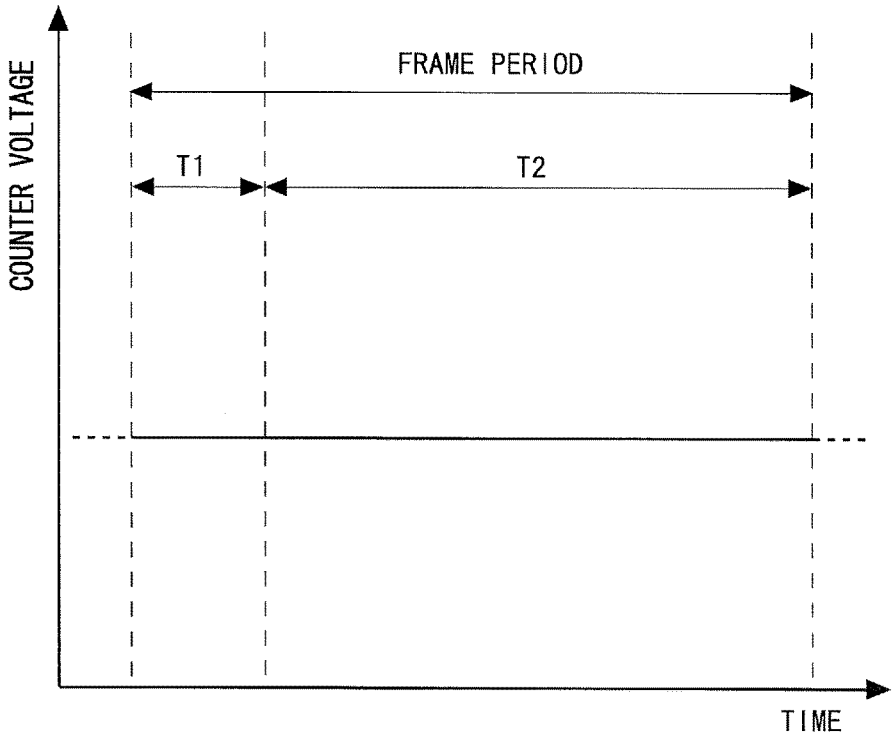
Figure 2:
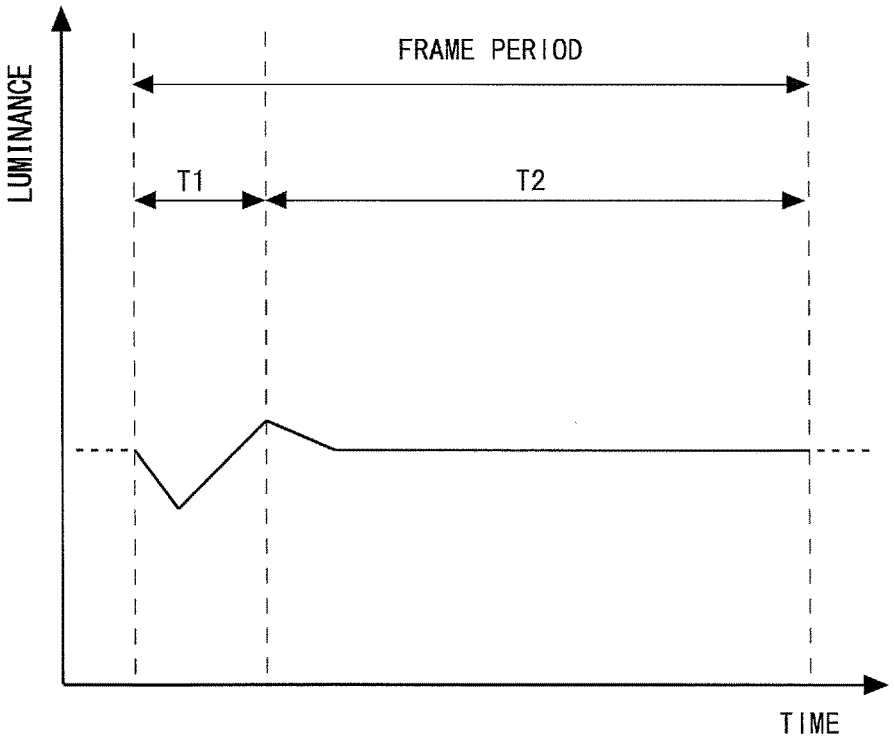
FIG. 2(*a*) is a diagram showing the change over time in the luminance of a negative polarity pixel of the liquid crystal display device shown in FIG. 1(*a*) during one frame period, and FIG. 2(*b*) is a diagram showing a counter voltage of the liquid crystal display device shown in FIG. 2(*a*) applied during a write period and a pause period.
Figure 2:
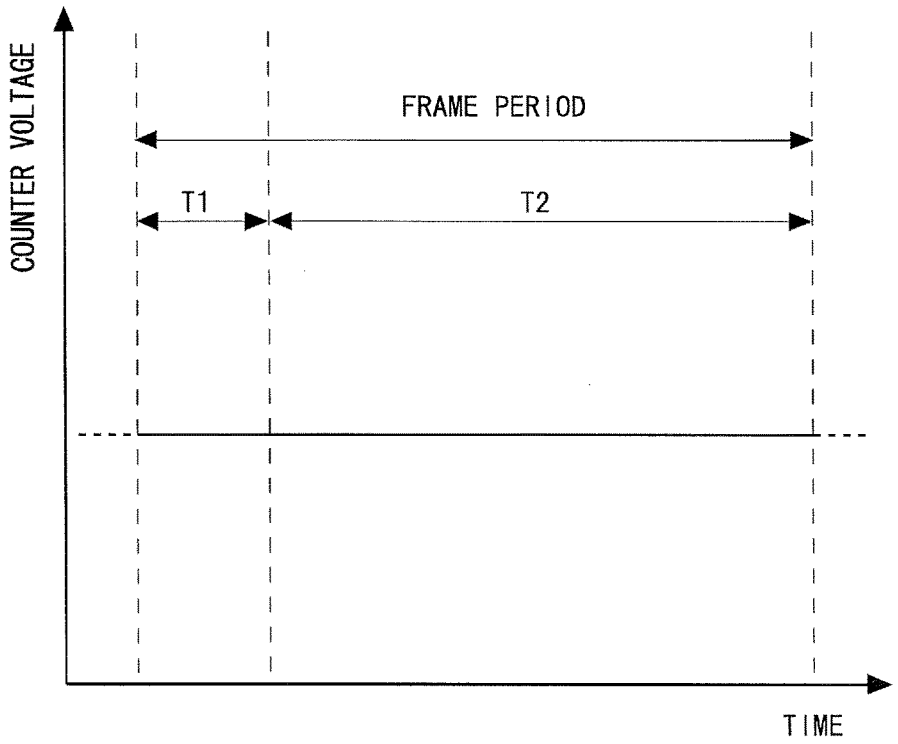

First, a problem occurring when a conventional liquid crystal display device performs pause driving will be described. FIG. 1(*a*) is a diagram showing the change over time in the luminance of a positive polarity pixel of a conventional liquid crystal display device during one frame period, and FIG. 1(*b*) is a diagram showing a counter voltage of the liquid crystal display device shown in FIG. 1(*a*) applied during a write period T1 and a pause period T2. FIG. 2(*a*) is a diagram showing the change over time in the luminance of a negative polarity pixel of the liquid crystal display device shown in FIG. 1(*a*) during one frame period, and FIG. 2(*b*) is a diagram showing a counter voltage of the liquid crystal display device shown in FIG. 2(*a*) applied during a write period T1 and a pause period T2.

Note that in the present specification the positive polarity pixel refers to a pixel formation portion in which the voltage of an image signal provided to a pixel electrode is higher than the counter voltage of a counter electrode, and the negative polarity pixel refers to a pixel formation portion in which the voltage of an image signal provided to a pixel electrode is lower than the counter voltage of a counter electrode. Note also that the write period T1 refers to a period during which image signals are written to pixel formation portions in a predetermined order, and the pause period T2 refers to a period during which the image signals written to the pixel formation portions are held to display an image, and one frame period includes a set of the write period T1 and the pause period T2.

As shown in FIG. 2(*b*), in the negative polarity pixel, the counter voltage of the counter electrode applied during the write period T1 and the pause period T2 is set to a reference value (constant value). In this case, as shown in FIG. 2(*a*), the change in luminance over time during the write period T1 is small and thus the occurrence of flicker is restrained.

However, as shown in FIG. 1(*b*), in the positive polarity pixel, even if the counter voltage of the counter electrode applied during the write period T1 and the pause period T2 is set to the same reference value as that for the case of FIG. 2(*b*), as shown in FIG. 1(*a*), the change in luminance over time during the write period T1 is large. Due to this, flicker occurs in an image displayed in the positive polarity pixel.

The reason that flicker thus occurs in the positive polarity pixel is considered that the voltage applied to the liquid crystal layer of the positive polarity pixel is higher than the voltage applied to the liquid crystal layer of the negative polarity pixel. The reason that the voltage applied to the liquid crystal layer of the positive polarity pixel increases is unknown, but the inventor of the invention of the present application considers the reason as follows. Specifically, one of the causes is considered that due to the influence of, for example, the polarization of the liquid crystal layer or the charge-up of an alignment film, the voltage applied to the liquid crystal layer differs between when a voltage higher than the counter voltage is applied to the pixel electrode and when a voltage lower than the counter voltage is applied. Furthermore, another cause of the increase in voltage applied to the liquid crystal layer of the positive polarity pixel is considered to be the fact that the voltage of an image signal provided to a data signal line changes due to a parasitic capacitance between a pixel electrode and the data signal line and accordingly the voltage of the pixel electrode fluctuates.

In view of this, the inventor of the invention of the present application considers reducing the voltage applied to the liquid crystal layer of the positive polarity pixel by applying a voltage higher than the reference value to the counter electrode of the positive polarity pixel during the write period T1.

Figure 3:
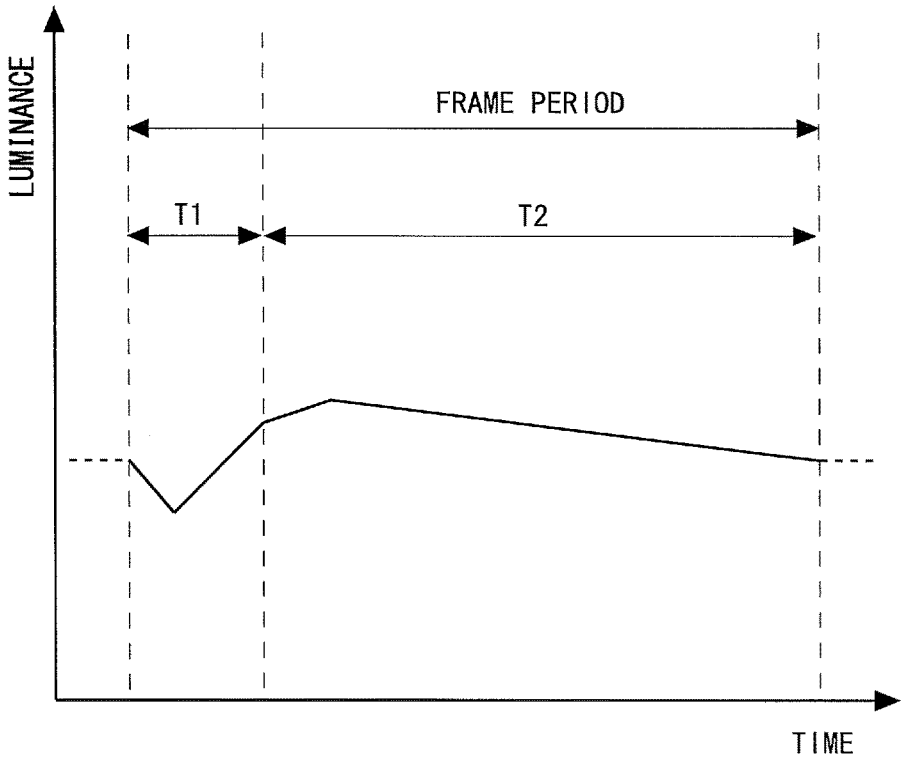
FIG. 3(*a*) is a diagram showing the change over time in the luminance of a positive polarity pixel of a liquid crystal display device used for consideration during one frame period, and FIG. 3(*b*) is a diagram showing a counter voltage of the liquid crystal display device shown in FIG. 3(*a*) applied during a write period and a pause period.
Figure 3:
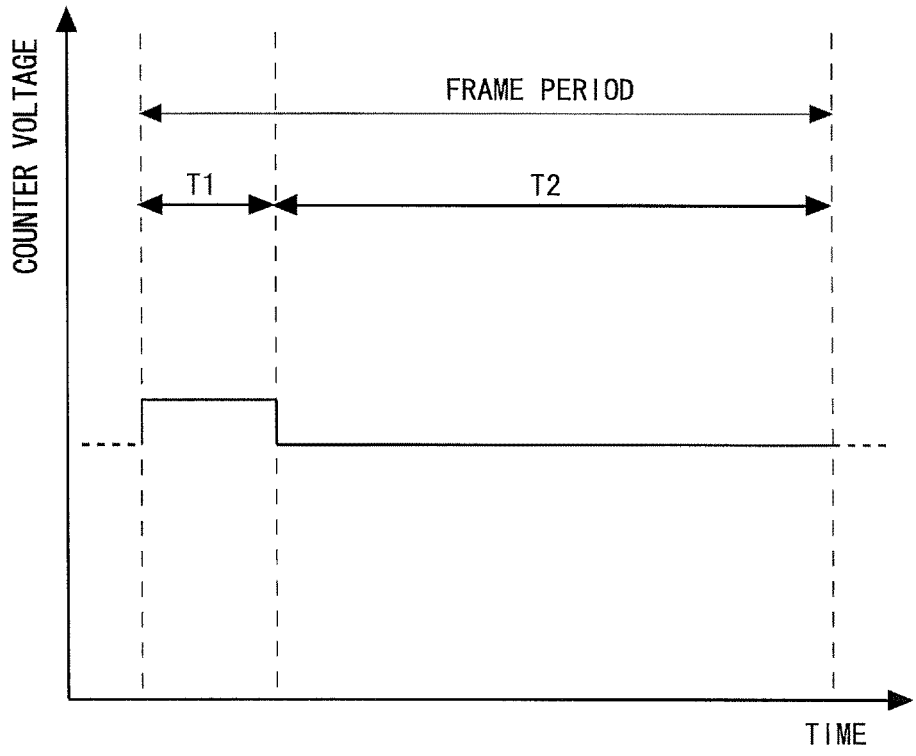
Figure 4:
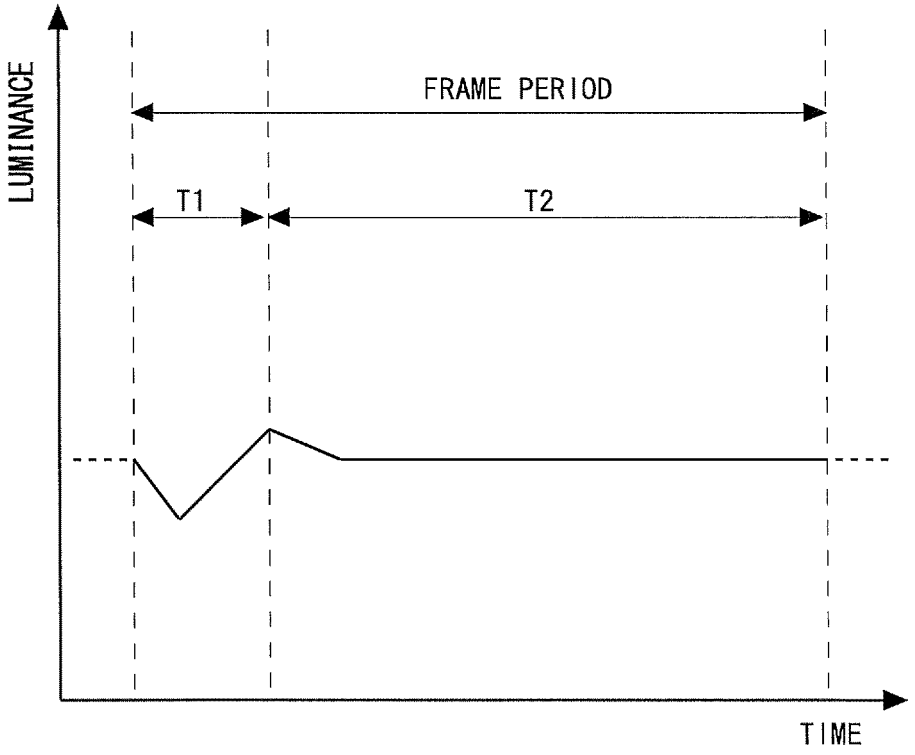
FIG. 4(*a*) is a diagram showing the change over time in the luminance of a negative polarity pixel of the liquid crystal display device shown in FIG. 3(*a*) during one frame period, and FIG. 4(*b*) is a diagram showing a counter voltage of the liquid crystal display device shown in FIG. 4(*a*) applied during a write period and a pause period.
Figure 4:
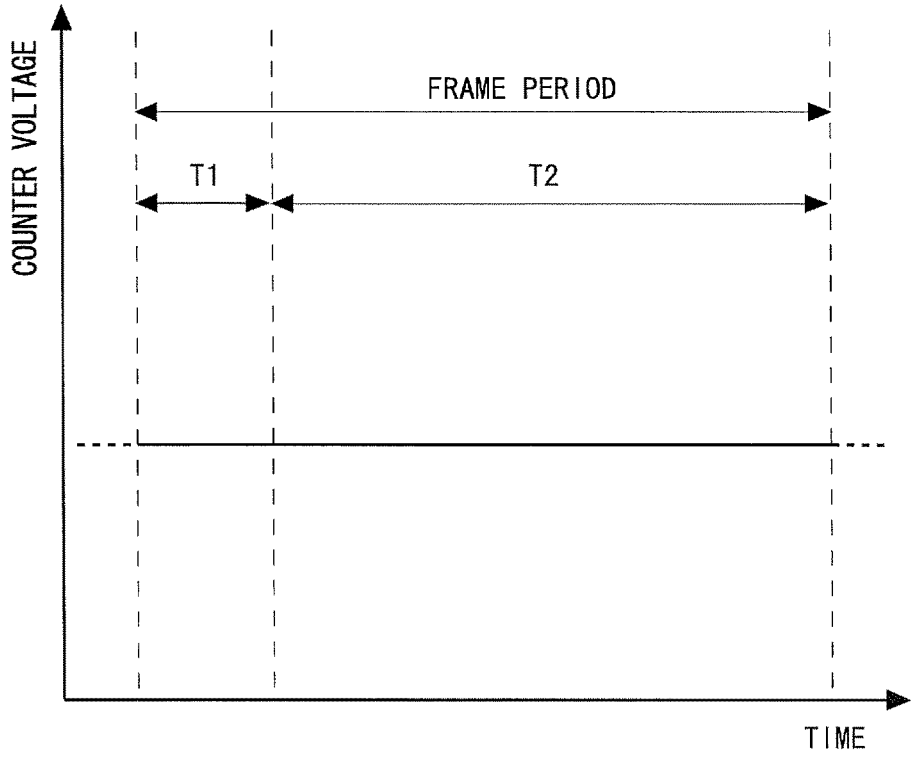

FIG. 3(*a*) is a diagram showing the change over time in the luminance of a positive polarity pixel of a liquid crystal display device used for consideration during one frame period, and FIG. 3(*b*) is a diagram showing a counter voltage of the liquid crystal display device shown in FIG. 3(*a*) applied during a write period T1 and a pause period T2. FIG. 4(*a*) is a diagram showing the change over time in the luminance of a negative polarity pixel of the liquid crystal display device shown in FIG. 3(*a*) during one frame period, and FIG. 4(*b*) is a diagram showing a counter voltage of the liquid crystal display device shown in FIG. 4(*a*) applied during a write period T1 and a pause period T2.

As shown in FIG. 4(*b*), in the negative polarity pixel, the counter voltage of the counter electrode applied during the write period T1 and the pause period T2 is set to the same reference value as that for the case shown in FIG. 2(*b*). Hence, as shown in FIG. 4(*a*), the change in luminance over time during the write period T1 is small and thus the occurrence of flicker is restrained. In the positive polarity pixel, however, as shown in FIG. 3(*b*), the voltage of the counter electrode applied during the write period T1 is set to be higher than that for the case of FIG. 1(*b*) and is brought back to the original reference value immediately before starting the pause period T2. By thus increasing the voltage of the counter electrode applied during the write period T1, a voltage which is the difference between the voltage applied to the pixel electrode and the voltage applied to the counter electrode is applied to the liquid crystal layer of the positive polarity pixel. Hence, in the positive polarity pixel, the voltage applied to the liquid crystal layer decreases by an amount corresponding to the increase in the voltage of the counter electrode during the write period T1, compared to the negative polarity pixel. The change in luminance over time is measured in this state, resulting in a decrease in change in luminance over time. From this fact, it has been found that the occurrence of flicker can be restrained. Note that, in the present specification, of the counter voltages applied during the write period T1, a voltage having the same reference value as the counter voltage applied during the pause period T2 may be referred to as a second voltage, and a voltage higher than the reference value may be referred to as a first voltage.

From the above, it can be seen that, when an image signal is written to the positive polarity pixel during the write period T1, by writing a voltage of the counter electrode set to be higher than the reference value and bringing the voltage back to the original reference value immediately before starting the pause period T2, the change over time in the luminance of the positive polarity pixel decreases, making it possible to restrain the occurrence of flicker even if the liquid crystal display device is one that writes image signals by any of a line-reversal driving scheme, a column-reversal driving scheme, and a dot-reversal driving scheme. Hence, in the following embodiments, liquid crystal display devices that write image signals by any of the line-reversal driving, column-reversal driving, and dot-reversal driving schemes during the write period T1 will be described.

Note that, when the frame frequency is high, the response time of liquid crystal is short and thus the change in luminance over time is small, and when the luminance rapidly changes up and down, the human eye cannot perceive such a change and thus the above-described problem does not occur.

2. First Embodiment

2.1 Configuration of a Liquid Crystal Display Device

Figure 5:
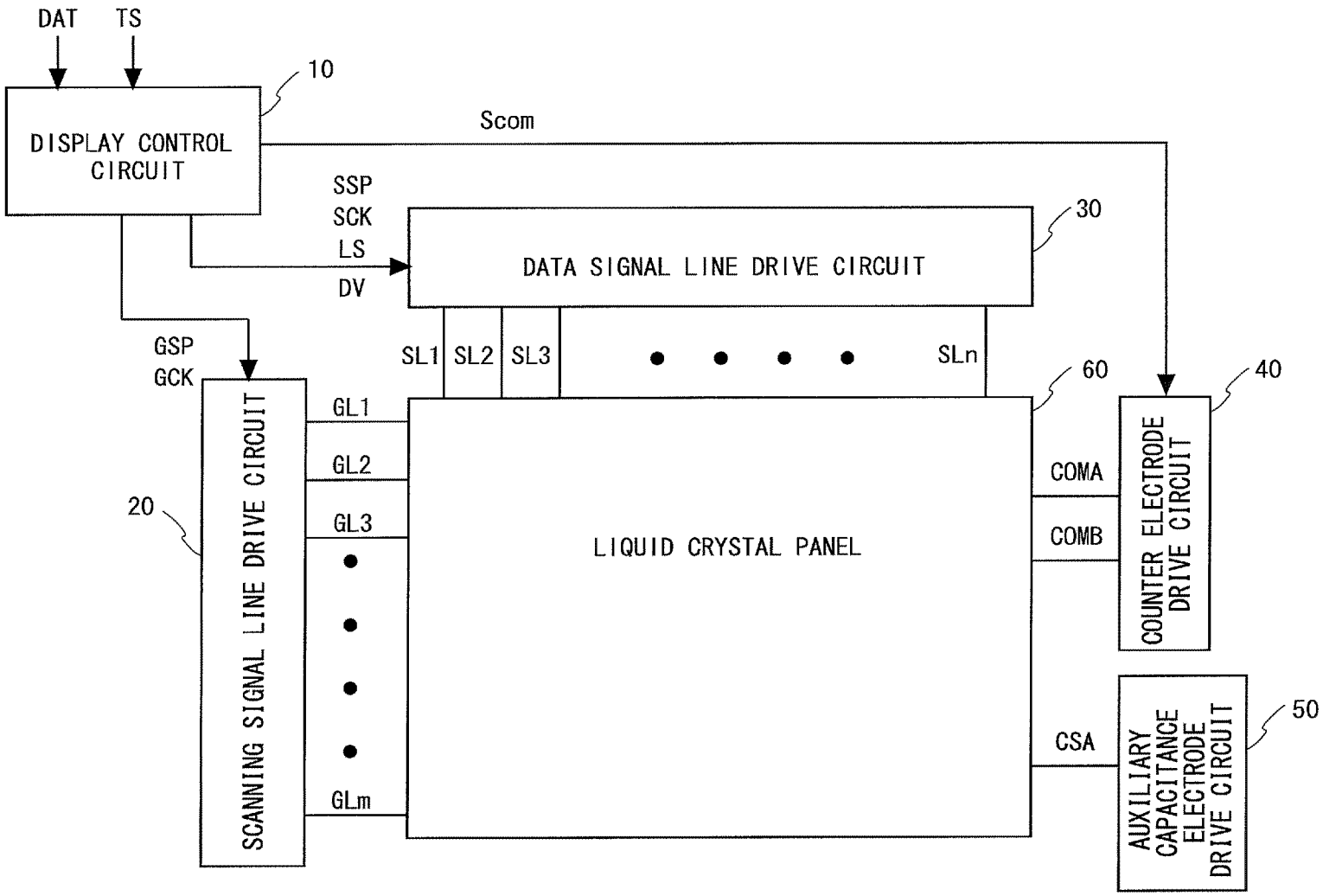
FIG. 5 is a block diagram showing an overall configuration of a liquid crystal display device according to a first embodiment of the present invention.

A liquid crystal display device of a line-reversal driving scheme according to a first embodiment of the present invention will be described. FIG. 5 is a block diagram showing an overall configuration of a liquid crystal display device according to the first embodiment of the present invention. As shown in FIG. 5, the liquid crystal display device includes a display control circuit 10, a scanning signal line drive circuit 20, a data signal line drive circuit 30, a counter electrode drive circuit 40, an auxiliary capacitance electrode drive circuit 50, and a liquid crystal panel 60. The liquid crystal panel 60 has m scanning signal lines GL1 to GLm (m is an integer greater than or equal to 1) and n data signal lines SL1 to SLn (n is an integer greater than or equal to 1) provided therein in a grid pattern. Pixel formation portions are disposed at the respective intersections of the scanning signal lines GL1 to GLm and the data signal lines SL1 to SLn. The scanning signal lines GL1 to GLm are connected to the scanning signal line drive circuit 20, and the data signal lines SL1 to SLn are connected to the data signal line drive circuit 30. In addition, the liquid crystal panel 60 is also provided with m counter electrode drive signal lines and m auxiliary capacitance electrode drive signal lines.

Figure 6:
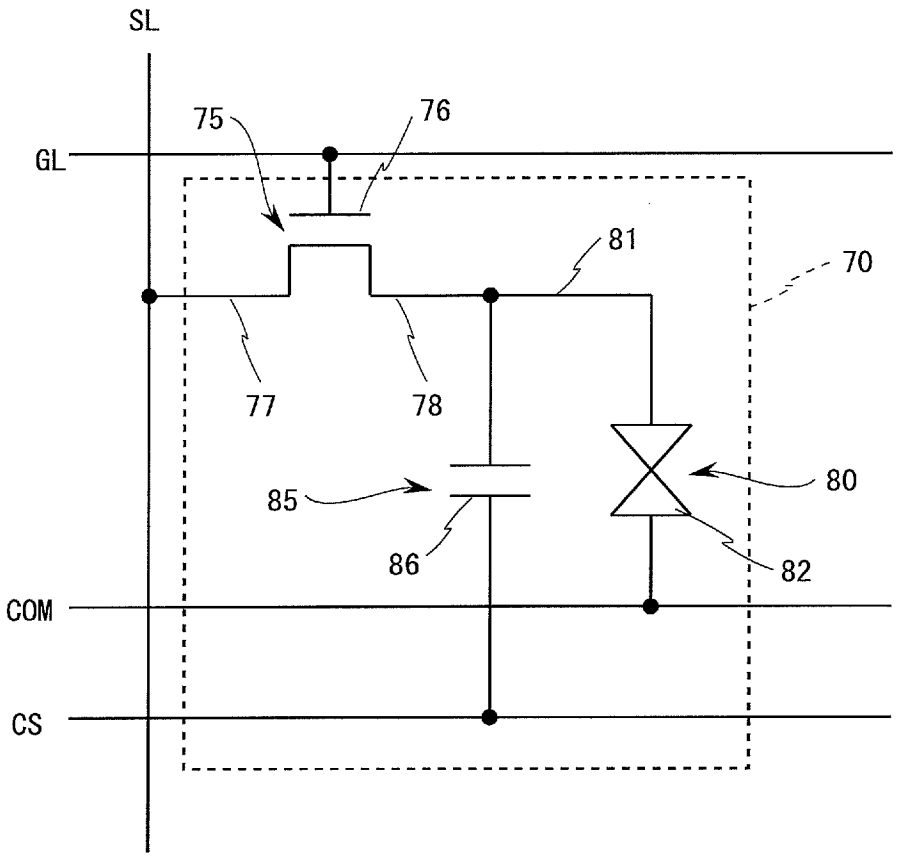
FIG. 6 is a circuit diagram showing an equivalent circuit of a pixel formation portion of the liquid crystal display device shown in FIG. 5.

FIG. 6 is a circuit diagram showing an equivalent circuit of a pixel formation portion 70. As shown in FIG. 6, the pixel formation portion 70 is provided with a thin film transistor (hereinafter, referred to as a "TFT") 75 as a switching element. A gate electrode 76 of the TFT 75 is connected to a scanning signal line GL, a source electrode 77 is connected to a data signal line SL, and a drain electrode 78 is connected to a pixel electrode 81.

In the present embodiment, as the TFT 75, for example, a TFT using an oxide semiconductor as a channel layer is used. More specifically, the channel layer of the TFT 75 is formed of IGZO (InGaZnOx) having indium (In), gallium (Ga), zinc (Zn), and oxide (O) as its main components. In such a TFT using IGZO as a channel layer, the off-leakage current significantly decreases compared to a silicon-based TFT using amorphous silicon or the like as a channel layer. Hence, voltages written to a liquid crystal capacitance 80 and an auxiliary capacitance 85 can be held for a longer period of time. Note that even when, as an oxide semiconductor other than IGZO, an oxide semiconductor including at least one of indium, gallium, zinc, copper (Cu), silicon (Si), tin (Sn), aluminum (Al), calcium (Ca), germanium (Ge), and lead (Pb), for example, is used as a channel layer, the same effect can be obtained.

Note that instead of using an oxide semiconductor as the channel layer of the TFT 75, polycrystalline silicon may be used.

In a TFT having a channel layer formed of polycrystalline silicon, the on-current is high. Use of such a TFT as a switching element enables miniaturization of the switching element. Accordingly, a display device with small pixel formation portions 70 and high definition can be implemented and pause driving can be performed in such a display device with high definition. Alternatively, instead of using an oxide semiconductor as the channel layer of the TFT 75, amorphous silicon may be used. A TFT having a channel layer formed of amorphous silicon can be manufactured at low cost. Use of such a TFT as a switching element makes it possible to perform pause driving by a low-cost display device.

Furthermore, the pixel formation portion 70 is provided with a liquid crystal capacitance 80 (which may be referred to as a "holding capacitance" in the present specification) and an auxiliary capacitance 85. The liquid crystal capacitance 80 includes the pixel electrode 81, a counter electrode 82, and a liquid crystal layer (not shown) sandwiched between the pixel electrode 81 and the counter electrode 82. The counter electrode 82 is connected to a counter electrode drive signal line COM, and the counter electrode drive signal line COM is connected to the counter electrode drive circuit 40. The auxiliary capacitance 85 includes the pixel electrode 81, an auxiliary capacitance electrode 86, and an insulating film (not shown) sandwiched between the pixel electrode 81 and the auxiliary capacitance electrode 86. The auxiliary capacitance electrode 86 is connected to an auxiliary capacitance electrode drive signal line CS, and the auxiliary capacitance electrode drive signal line CS is connected to the auxiliary capacitance electrode drive circuit 50.

The display control circuit 10 receives a display data signal DAT and a timing control signal TS from an external source, and outputs a gate start pulse signal GSP and a gate clock signal GCK to the scanning signal line drive circuit 20. In addition, the display control circuit 10 outputs a display digital image signal DV, a source start pulse signal SSP, a source clock signal SCK, and a latch strobe signal LS to the data signal line drive circuit 30. To select each scanning signal line GL in turn for each horizontal scanning period, the scanning signal line drive circuit 20 repeats application of an active scanning signal to each of the scanning signal lines GL1 to GLm in turn in cycles of one vertical scanning period. The data signal line drive circuit 30 generates image signals for driving the liquid crystal panel 60, and provides the image signals to the data signal lines SL1 to SLn of the liquid crystal panel 60. The counter electrode drive circuit 40 drives the counter electrodes 82, and the auxiliary capacitance electrode drive circuit 50 drives the auxiliary capacitance electrodes 86.

Figure 7:
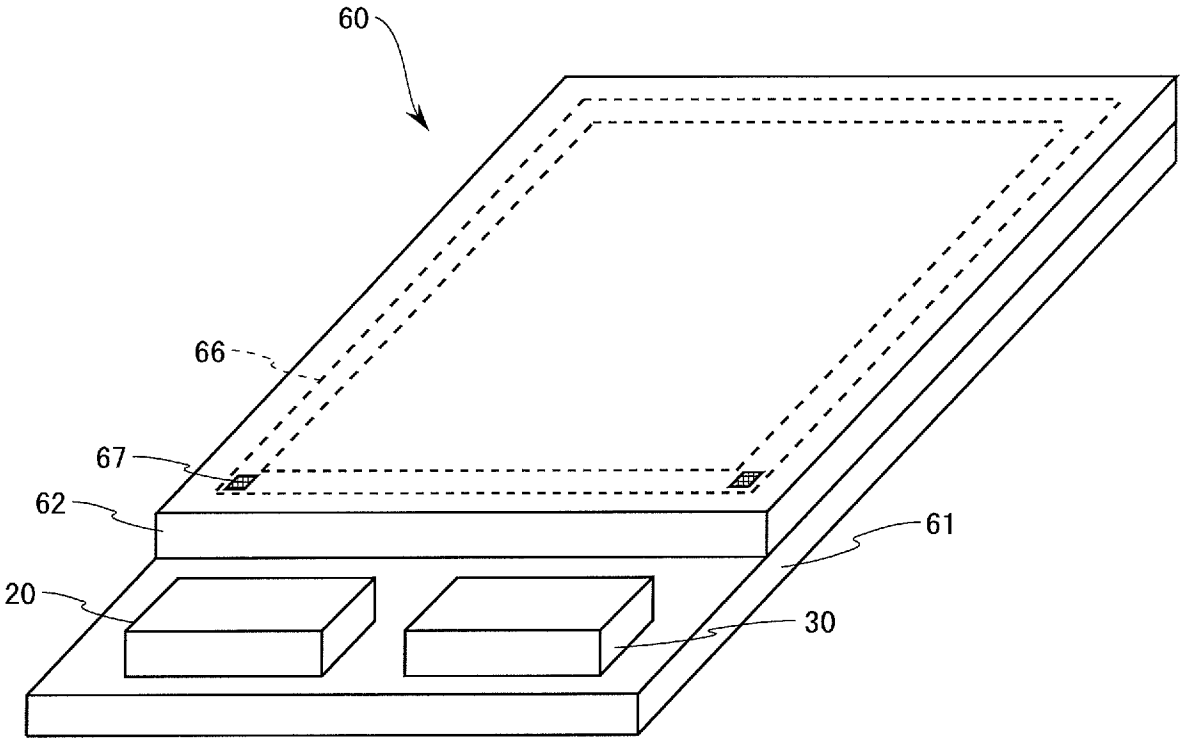
FIG. 7 is a perspective view showing a schematic configuration of a liquid crystal panel of the liquid crystal display device shown in FIG. 5.

FIG. 7 is a perspective view showing a schematic configuration of the liquid crystal panel 60. As shown in FIG. 7, the liquid crystal panel 60 includes of an array substrate 61, a counter substrate 62, and a liquid crystal layer (not shown) sandwiched between the substrates 61 and 62. As spacers for maintaining a constant distance between the array substrate 61 and the counter substrate 62, plastic beads (not shown) having uniform particle size are each scattered between the array substrate 61 and the counter substrate 62. The array substrate 61 and the counter substrate 62 are joined together by a rectangular frame-like sealing material 66 formed therearound.

In the liquid crystal panel 60 that can perform color display, a plurality of data signal lines and a plurality of scanning signal lines are formed on the array substrate 61 so as to intersect each other, and pixel formation portions, each including a TFT and a pixel electrode, are formed in a matrix form near the intersections of the data signal lines and the scanning signal lines. A surface of such an array substrate 61 is covered with an alignment film.

On the counter substrate 62 there are formed a color filter including colored layers of red, green, and blue, counter electrodes, and an alignment film in this order. The array substrate 61 and the counter substrate 62 are disposed with a constant distance provided therebetween such that the alignment films formed thereon face each other. Electrode transfer materials 67 made of, for example, a silver paste are disposed at corners of the counter substrate 62 and at locations on the array substrate 61 facing the corners. The array substrate 61 and the counter substrate 62 are electrically connected to each other by the electrode transfer materials 67, and a counter voltage provided to the array substrate 61 from an external source is applied to the counter electrodes through the electrode transfer materials 67. The liquid crystal layer is filled in a space surrounded by the alignment films formed on the surfaces of the array substrate 61 and the counter substrate 62, respectively, and the sealing material 66. Note that the scanning signal line drive circuit 20 and the data signal line drive circuit 30 are disposed on an overhanging portion of the array substrate 61 and are connected to the scanning signal lines and the data signal lines on the array substrate 61, respectively.

2.2 Liquid Crystal Panel

Figure 8:
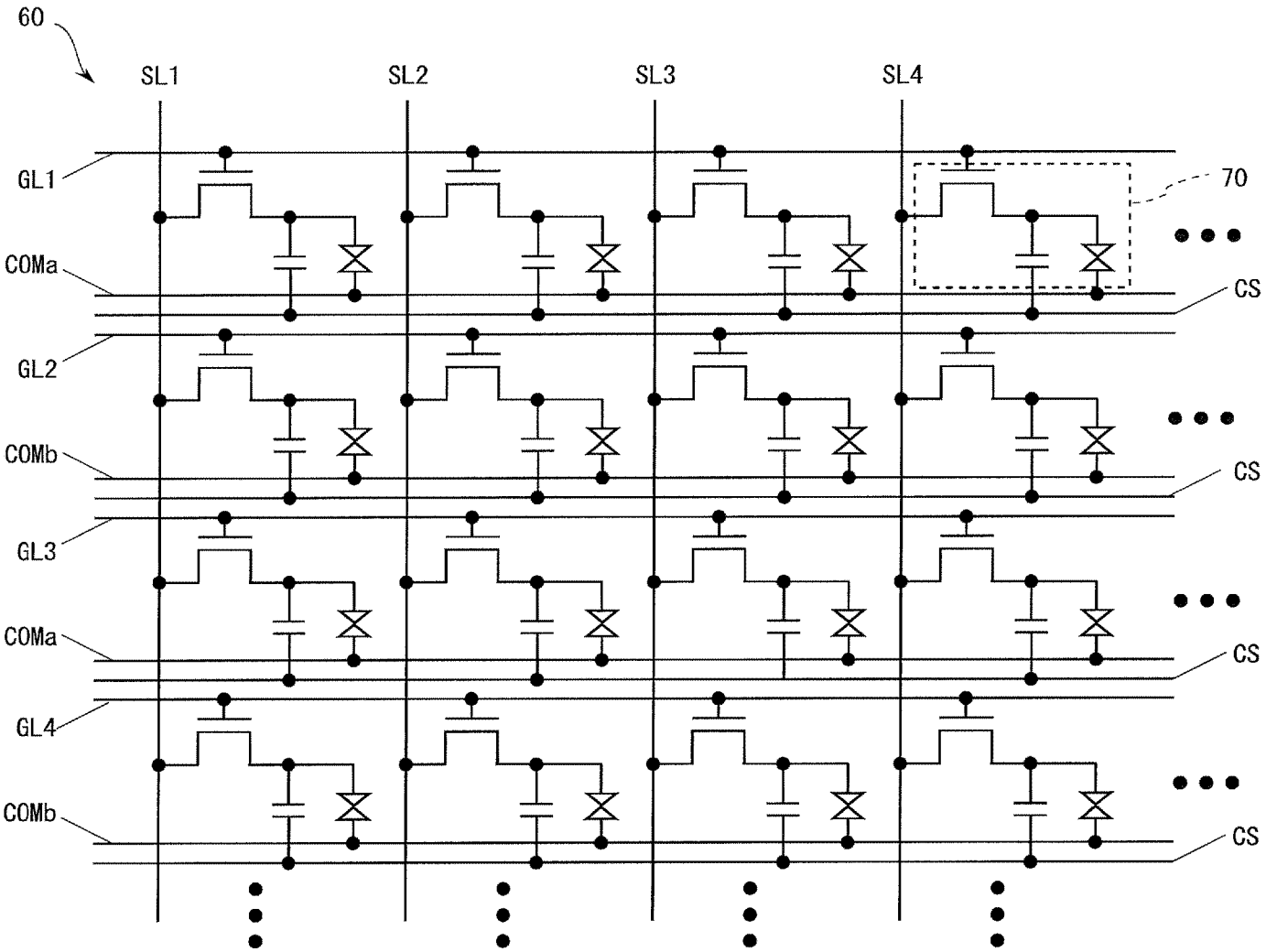
FIG. 8 is a diagram showing a connection relationship between a plurality of pixel formation portions disposed in the liquid crystal panel used for line-reversal driving in the liquid crystal display device shown in FIG. 5.

A plurality of pixel formation portions 70 are arranged in a matrix form in the liquid crystal panel 60. A connection relationship within each pixel formation portion 70 is the same as that for the case shown in FIG. 6 and thus a description thereof is omitted, and a connection relationship between the pixel formation portions 70 will be described. FIG. 8 is a diagram showing a connection relationship between a plurality of pixel formation portions 70 disposed in the liquid crystal panel 60 used for line-reversal driving. Note that in FIG. 8, for ease of reference, the number of pixel formation portions 70 arranged in the liquid crystal panel 60 is 4×4; however, in practice, m×n pixel formation portions 70 are disposed. The same also applies to second and third embodiments which will be described later.

As shown in FIG. 8, m auxiliary capacitance electrode drive signal lines CS are disposed in parallel to scanning signal lines GL1 to GLm. The auxiliary capacitance electrode drive signal lines CS are connected to auxiliary capacitance electrodes 86 of the pixel formation portions 70 disposed in a row direction (horizontal direction in FIG. 8). The m auxiliary capacitance electrode drive signal lines CS are connected to one another, becoming an auxiliary capacitance electrode drive signal line CSA, and the auxiliary capacitance electrode drive signal line CSA is connected to the auxiliary capacitance electrode drive circuit 50. By this, by the auxiliary capacitance electrode drive circuit 50 applying an auxiliary capacitance drive voltage for driving the auxiliary capacitance electrodes 86 to the auxiliary capacitance electrode drive signal line CSA, the auxiliary capacitance drive voltage can be applied to the auxiliary capacitance electrodes 86 of the pixel formation portions 70.

In addition, m counter electrode drive signal lines are disposed in parallel to the scanning signal lines GL1 to GLm. The counter electrode drive signal lines are connected to the counter electrodes 82 of the pixel formation portions 70 disposed in the row direction. As will be described later, during a write period T1, different counter voltages are provided to the counter electrode drive signal lines in the odd-numbered rows and the counter electrode drive signal lines in the even-numbered rows of the m counter electrode drive signal lines. Hence, in the present embodiment, the counter electrode drive signal lines in the odd-numbered rows are referred to as COMa and the counter electrode drive signal lines in the even-numbered rows are referred to as COMb. The counter electrode drive signal lines COMa are connected to one another, becoming a counter electrode drive signal line COMA, and the counter electrode drive signal lines COMb are connected to one another, becoming a counter electrode drive signal line COMB. The counter electrode drive signal lines COMA and COMB are connected to the counter electrode drive circuit 40. The counter electrode drive circuit 40 applies different counter voltages for driving the counter electrodes 82 to the counter electrode drive signal lines in the odd-numbered rows COMa and the counter electrode drive signal lines in the even-numbered rows COMb through the counter electrode drive signal lines COMA and COMB. By this, the counter electrode drive circuit 40 can apply different counter voltages to the counter electrodes 82 of the pixel formation portions 70 disposed in the odd-numbered rows and the counter electrodes 82 of the pixel formation portions 70 disposed in the even-numbered rows.

Figure 9:
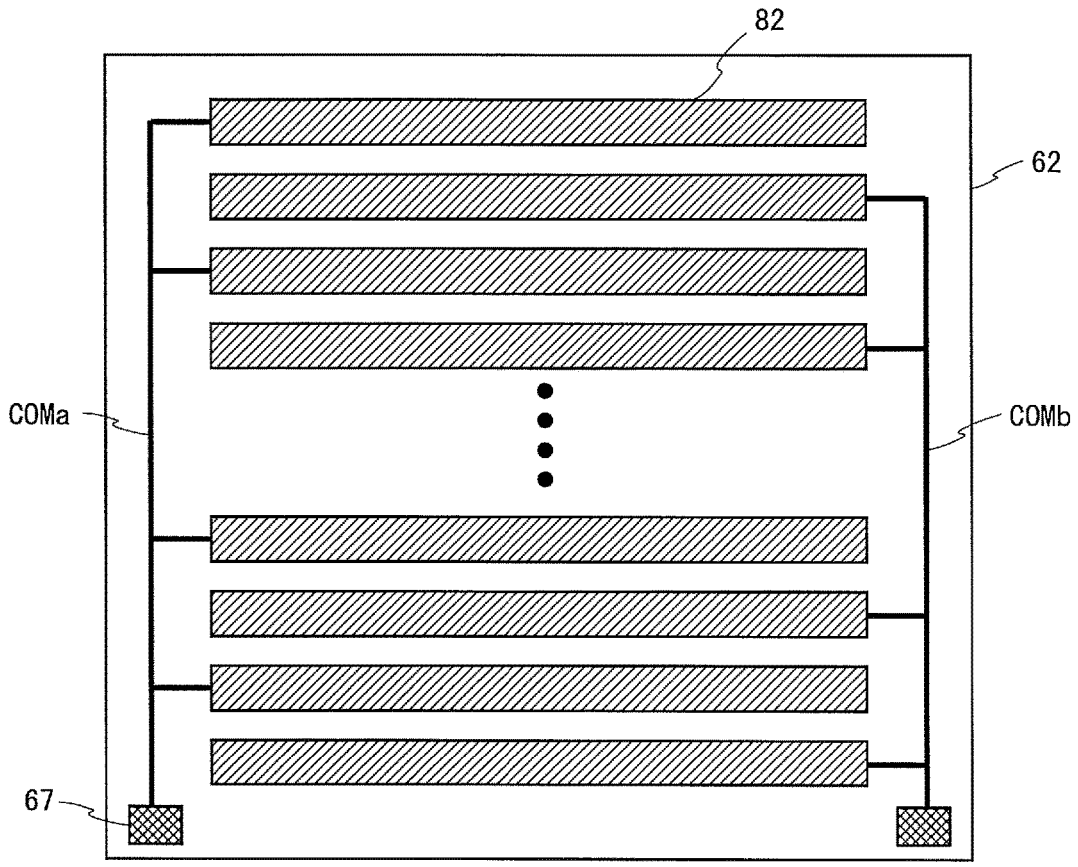
FIG. 9 is a diagram showing disposition of counter electrodes for performing line-reversal driving in the liquid crystal display device shown in FIG. 5.

FIG. 9 is a diagram showing disposition of the counter electrodes 82 for performing line-reversal driving. As shown in FIG. 9, m rectangular counter electrodes 82 extending in a row direction (horizontal direction in FIG. 9) are formed at locations on the counter substrate 62 corresponding to n pixel formation portions formed in the row direction on the array substrate 61. The counter electrode drive signal lines COMa are connected to the counter electrodes 82 in the odd-numbered rows, and the counter electrode drive signal lines COMb are connected to the counter electrodes 82 in the even-numbered rows. In addition, the counter electrode drive signal lines COMa and COMb are connected to the array substrate 61 by the electrode transfer materials 67, respectively. By this, different counter voltages can be applied to the counter electrodes 82 in the odd-numbered rows and the counter electrodes 82 in the even-numbered rows.

2.3 Drive Method

Figure 10:
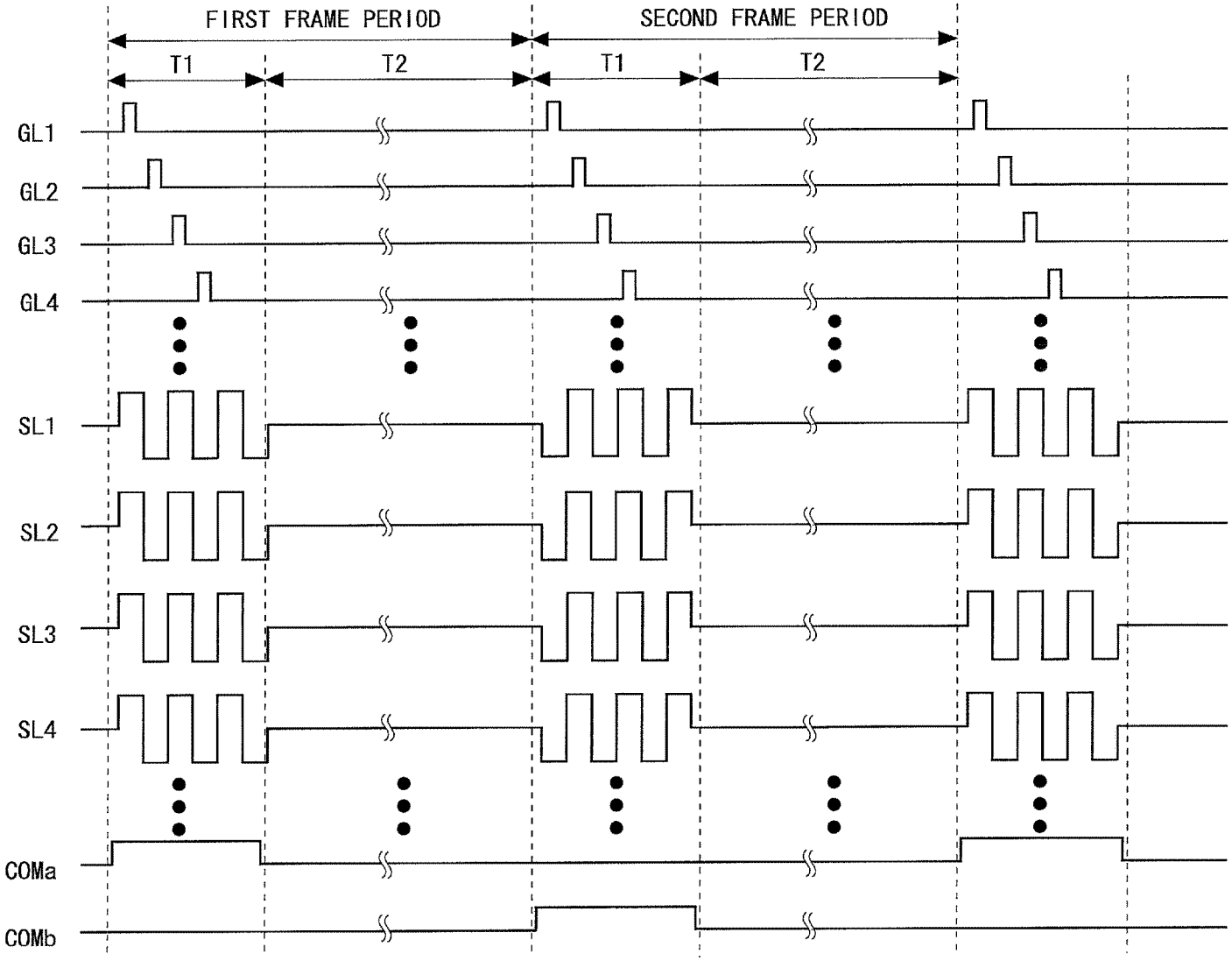
FIG. 10 is a timing chart for allowing the liquid crystal panel shown in FIG. 8 to perform line-reversal driving.

FIG. 10 is a timing chart for allowing the liquid crystal panel 60 shown in FIG. 8 to perform line-reversal driving. FIG. 11(*a*) is a diagram showing the locations of positive polarity pixels and negative polarity pixels for when the liquid crystal panel 60 shown in FIG. 8 performs line-reversal driving during odd-numbered frame periods, and FIG. 11(*b*) is a diagram showing the locations of positive polarity pixels and negative polarity pixels for when the liquid crystal panel 60 shown in FIG. 8 performs line-reversal driving during even-numbered frame periods.

As shown in FIG. 10, each frame period includes a write period T1 for writing image signals to the pixel formation portions 70; and a pause period T2 for holding the image signals written to the pixel formation portions 70 during the write period T1 to display an image on the liquid crystal panel 60. Note that it is preferred that the pause period T2 be longer than the write period T1. Note also that it is preferred that one frame period be a period longer than 1/60 seconds. By this, an image where the occurrence of flicker is effectively restrained can be displayed with low power consumption.

First, during a write period T1 of a first frame period, an active scanning signal (high-level scanning signal) is applied in turn to the m scanning signal lines GL1 to GLm. By this, in the pixel formation portions 70 connected to the scanning signal line to which the high-level scanning signal has been applied, the TFTs 75 are placed in an on state. On the other hand, an image signal (hereinafter, referred to as a "positive image signal") having a signal voltage higher than a counter voltage and an image signal (hereinafter, referred to as a "negative image signal") having a signal voltage lower than the counter voltage are alternately outputted to the n data signal lines SL1 to SLn every time a high-level scanning signal is outputted. In addition, the signal voltage of the positive image signal may be referred to as a "positive signal voltage" and the signal voltage of the negative image signal as a "negative signal voltage".

For example, when a high-level scanning signal is provided to the scanning signal line GL1, the TFTs 75 of the pixel formation portions 70 connected to the scanning signal line GL1 are placed in an on state, and positive image signals are written to the liquid crystal capacitances 80 and the auxiliary capacitances 85 of the pixel formation portions 70 through the data signal lines SL1 to SLn. Thereafter, the scanning signal changes from the high level to a low level, and the TFTs 75 of the pixel formation portions 70 connected to the scanning signal line GL1 are placed in an off state.

Then, when a high-level scanning signal is provided to the scanning signal line GL2, the TFTs 75 of the pixel formation portions 70 connected to the scanning signal line GL2 are placed in an on state, and negative image signals are written to the liquid crystal capacitances 80 and the auxiliary capacitances 85 of the pixel formation portions 70 through the data signal lines SL1 to SLn. Thereafter, the scanning signal changes from the high level to a low level, and the TFTs 75 of the pixel formation portions 70 connected to the scanning signal line GL2 are placed in an off state.

Thereafter, likewise, when a high-level scanning signal is applied to a scanning signal line in an odd-numbered row GL(2*i*-1) (i is an integer of $1 \leq i \leq m$), positive image signals are written to the pixel formation portions 70 connected to the scanning signal line in the odd-numbered row GL(2*i*-1). Thus, the pixel formation portions 70 connected to the scanning signal line in the odd-numbered row GL(2*i*-1) become positive polarity pixels. In addition, when a high-level scanning signal is applied to a scanning signal line in an even-numbered row GL (2*i*), negative image signals are written to the pixel formation portions 70 connected to the scanning signal line in the even-numbered row GL(2*i*). Thus, the pixel formation portions 70 connected to the scanning signal line in the even-numbered row GL(2*i*) become negative polarity pixels. As a result, as shown in FIG. 11(*a*), positive polarity pixels and negative polarity pixels are disposed alternately on a row-by-row basis in the liquid crystal panel 60.

At this time, a counter voltage higher than a reference value is applied to the counter electrode drive signal lines COMa connected to the counter electrodes 82 of the pixel formation portions 70 in the odd-numbered rows that become positive polarity pixels. A counter voltage identical to the reference value is applied to the counter electrode drive signal lines COMb connected to the counter electrodes 82 of the pixel formation portions 70 in the even-numbered rows that become negative polarity pixels.

When image signals are written to all of the pixel formation portions 70, a transition from the write period T1 to a pause period T2 is made. During the pause period T2, all of the scanning signals applied to the scanning signal lines GL1 to GLm go to a low level. Image signals applied to the data signal lines SL1 to SLn go to an intermediate level between the positive polarity and the negative polarity (hereinafter, referred to as an "intermediate level"). Immediately before transitioning to the pause period T2, the counter voltage applied to the counter electrode drive signal lines in the odd-numbered rows COMa is brought back to the original reference value from the voltage higher than the reference value. Note that the counter voltage applied to the counter electrode drive signal lines in the even-numbered rows COMb has the same reference value as that for the write period T1.

Then, during a write period T1 of a second frame period, as with the write period T1 of the first frame period, a high-level scanning signal is applied in turn to the m scanning signal lines GL1 to GLm, and image signals, each alternately repeating the positive polarity and the negative polarity in synchronization with when the scanning signal goes to a high level, are provided to the data signal lines SL1 to SLn.

However, unlike the case of the write period T1 of the first frame period, when a high-level scanning signal is provided to the scanning signal line in the first row GL1, negative image signals are provided to the data signal lines SL1 to SLn. Then, when a high-level scanning signal is provided to the scanning signal line in the second row GL2, positive image signals are provided to the data signal lines SL1 to SLn. Thereafter, likewise, when a high-level scanning signal is applied to a scanning signal line in an odd-numbered row GL(2*i*-1), negative image signals are written to the pixel formation portions 70 connected to the scanning signal line in the odd-numbered row GL(2*i*-1). Thus, the pixel formation portions 70 connected to the scanning signal line in the odd-numbered row GL(2*i*-1) become negative polarity pixels. In addition, when a high-level scanning signal is applied to a scanning signal line in an even-numbered row GL(2*i*), positive image signals are written to the pixel formation portions 70 connected to the scanning signal line in the even-numbered row GL(2*i*). Thus, the pixel formation portions 70 connected to the scanning signal line in the even-numbered row GL(2*i*) become positive polarity pixels. As a result, as shown in FIG. 11(*b*), negative polarity pixels and positive polarity pixels are disposed alternately on a row-by-row basis in the liquid crystal panel 60.

At this time, a counter voltage identical to the reference value is applied to the counter electrode drive signal lines COMa connected to the counter electrodes 82 of the pixel formation portions 70 in the odd-numbered rows that become negative polarity pixels. A counter voltage higher than the reference value is applied to the counter electrode drive signal lines COMb connected to the counter electrodes 82 of the pixel formation portions 70 in the even-numbered rows that become positive polarity pixels.

When image signals are written to all of the pixel formation portions 70, a transition from the write period T1 to a pause period T2 is made. Immediately before transitioning to the pause period T2, the counter voltage applied to the counter electrode drive signal lines in the even-numbered rows COMb is brought back to the original reference value from the voltage higher than the reference value. Note that the counter voltage applied to the counter electrode drive signal lines in the odd-numbered rows COMa has the same reference value as that for the write period T1.

Thereafter, likewise, during a write period T1 of an odd-numbered frame period, the pixel formation portions 70 connected to the scanning signal lines in the odd-numbered rows GL(2*i*-1) become positive polarity pixels. However, since a voltage higher than the reference value is applied to the counter electrode drive signal lines COMa, a voltage applied to the liquid crystal layer decreases. By this, the change in luminance over time decreases. During a write period T1 of an even-numbered frame period, the pixel formation portions 70 connected to the scanning signal lines in the even-numbered rows GL(2*i*) become positive polarity pixels. However, since a voltage of a voltage higher than the reference value is applied to the counter electrode drive signal lines COMb, a voltage applied to the liquid crystal layer decreases. By this, the change in luminance over time decreases.

2.4 Effects

According to the above-described embodiment, during the write period T1, a counter voltage applied to counter electrode drive signal lines connected to positive polarity pixels is set to be higher than the reference value, by which drive voltages held in the liquid crystal capacitances 80 of the positive polarity pixels decrease. As a result, the change over time in the luminance of the positive polarity pixels decreases, restraining the occurrence of flicker.

In addition, during the write period T1, a counter voltage applied to counter electrode drive signal lines connected to negative polarity pixels is set to be identical to the reference value. By this, the drive voltages of the positive polarity pixels and the negative polarity pixels during the pause period T2 become equal to each other, further restraining the occurrence of flicker.

3. Second Embodiment

A liquid crystal display device of a column-reversal driving scheme according to a second embodiment of the present invention will be described. A block diagram showing an overall configuration of a liquid crystal display device according to the present embodiment is the same as that shown in FIG. 5, and thus, a block diagram showing the overall configuration and a description thereof are omitted.

3.1 Liquid Crystal Panel

Figure 12:
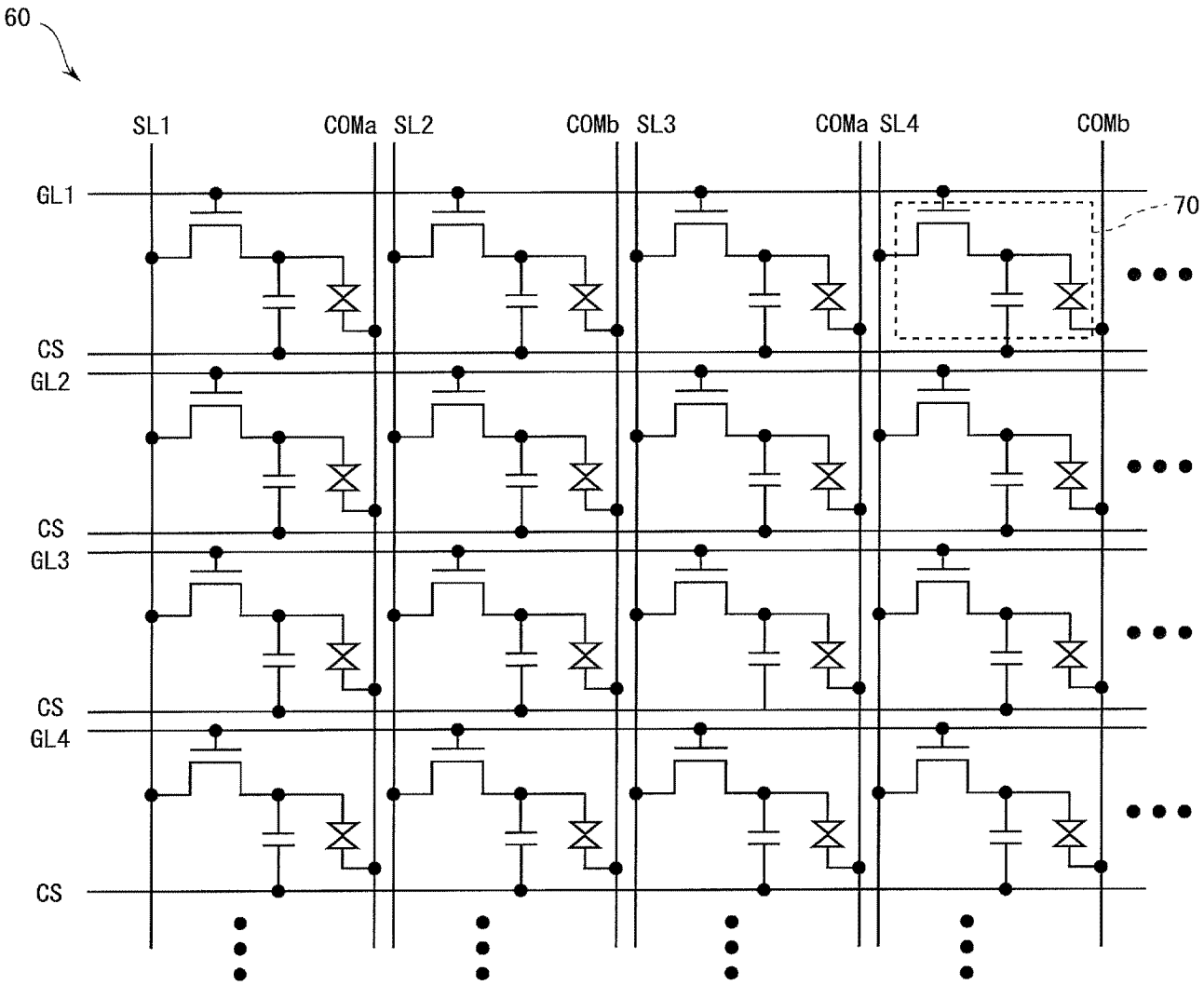
FIG. 12 is a diagram showing a connection relationship between a plurality of pixel formation portions disposed in a liquid crystal panel used for column-reversal driving in a liquid crystal display device according to a second embodiment of the present invention.

FIG. 12 is a diagram showing a connection relationship between a plurality of pixel formation portions 70 disposed in a liquid crystal panel 60 used for column-reversal driving. Note that the disposition of scanning signal lines GL1 to GLm and auxiliary capacitance electrode drive signal lines CS is the same as that for the case shown in FIG. 8, and thus, a description thereof is omitted.

In data signal lines SL1 to SLn are disposed so as to intersect the scanning signal lines GL1 to GLm. In addition, n counter electrode drive signal lines are disposed in parallel to the data signal lines SL1 to SLn. The counter electrode drive signal lines are connected to counter electrodes 82 of the pixel formation portions 70 disposed in a column direction (vertical direction in FIG. 12). As will be described later, during a write period T1, different counter voltages are provided to counter electrode drive signal lines in the odd-numbered columns and counter electrode drive signal lines in the even-numbered columns of the n counter electrode drive signal lines. Hence, in the present embodiment, the counter electrode drive signal lines in the odd-numbered columns are referred to as COMa and the counter electrode drive signal lines in the even-numbered columns are referred to as COMb. The counter electrode drive signal lines COMa are connected to one another, becoming a single counter electrode drive signal line COMA, and the counter electrode drive signal lines COMb are connected to one another, becoming a single counter electrode drive signal line COMB. The counter electrode drive signal lines COMA and COMB are connected to a counter electrode drive circuit 40. The counter electrode drive circuit 40 applies different counter voltages for driving the counter electrodes 82 to the counter electrode drive signal lines in the odd-numbered columns COMa and the counter electrode drive signal lines in the even-numbered columns COMb through the counter electrode drive signal lines COMA and COMB. By this, the counter electrode drive circuit 40 can apply different counter voltages to the counter electrodes 82 of the pixel formation portions 70 disposed in the odd-numbered columns and the counter electrodes of the pixel formation portions 70 disposed in the even-numbered columns.

Figure 13:
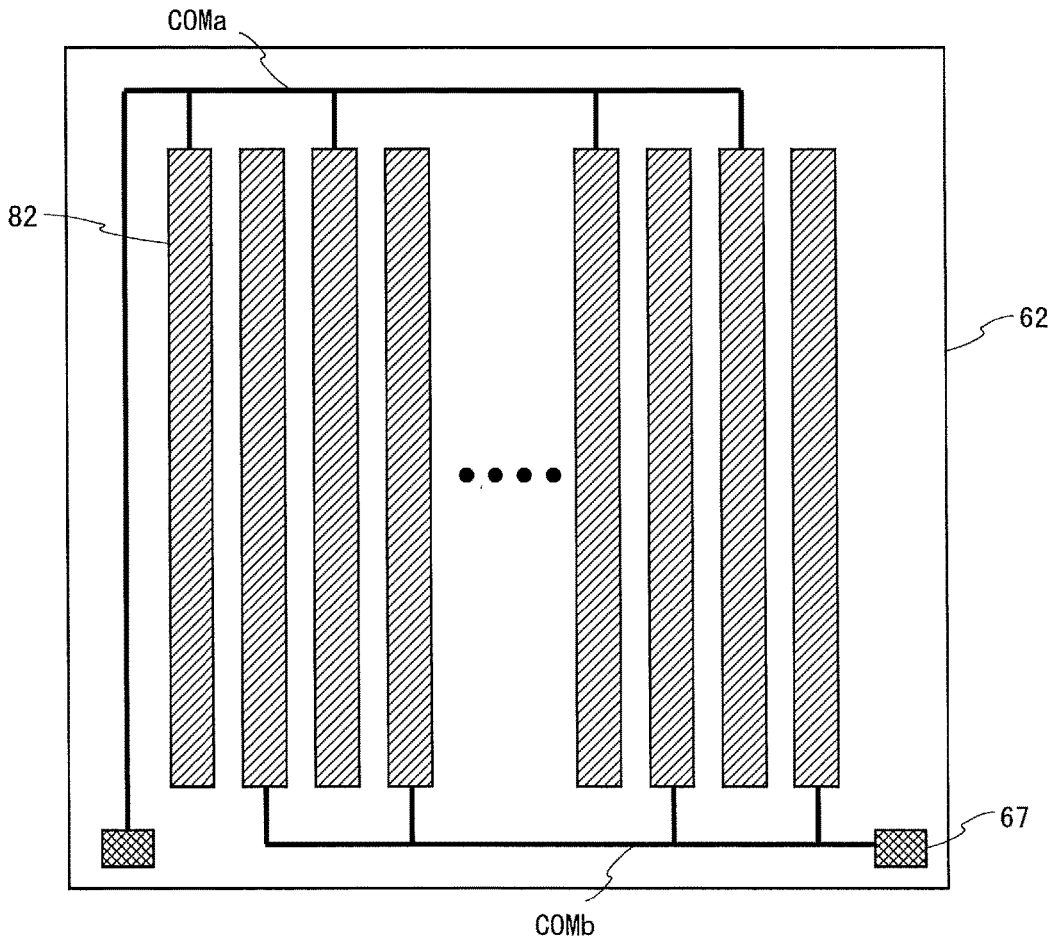
FIG. 13 is a diagram showing disposition of counter electrodes for performing column-reversal driving in the liquid crystal display device according to the second embodiment of the present invention.

FIG. 13 is a diagram showing disposition of the counter electrodes 82 for performing column-reversal driving. As shown in FIG. 13, n rectangular counter electrodes 82 extending in a column direction (vertical direction in FIG. 13) are formed at locations on a counter substrate 62 corresponding to m pixel formation portions formed in the column direction on an array substrate 61. The counter electrode drive signal lines COMa are connected to the counter electrodes 82 in the odd-numbered columns, and the counter electrode drive signal lines COMb are connected to the counter electrodes 82 in the even-numbered columns. In addition, the counter electrode drive signal lines COMa and COMb are connected to the array substrate 61 by electrode transfer materials 67, respectively. Hence, different counter voltages can be applied to the counter electrodes 82 in the odd-numbered columns and the counter electrodes 82 in the even-numbered columns.

3.2 Drive Method

Figure 14:
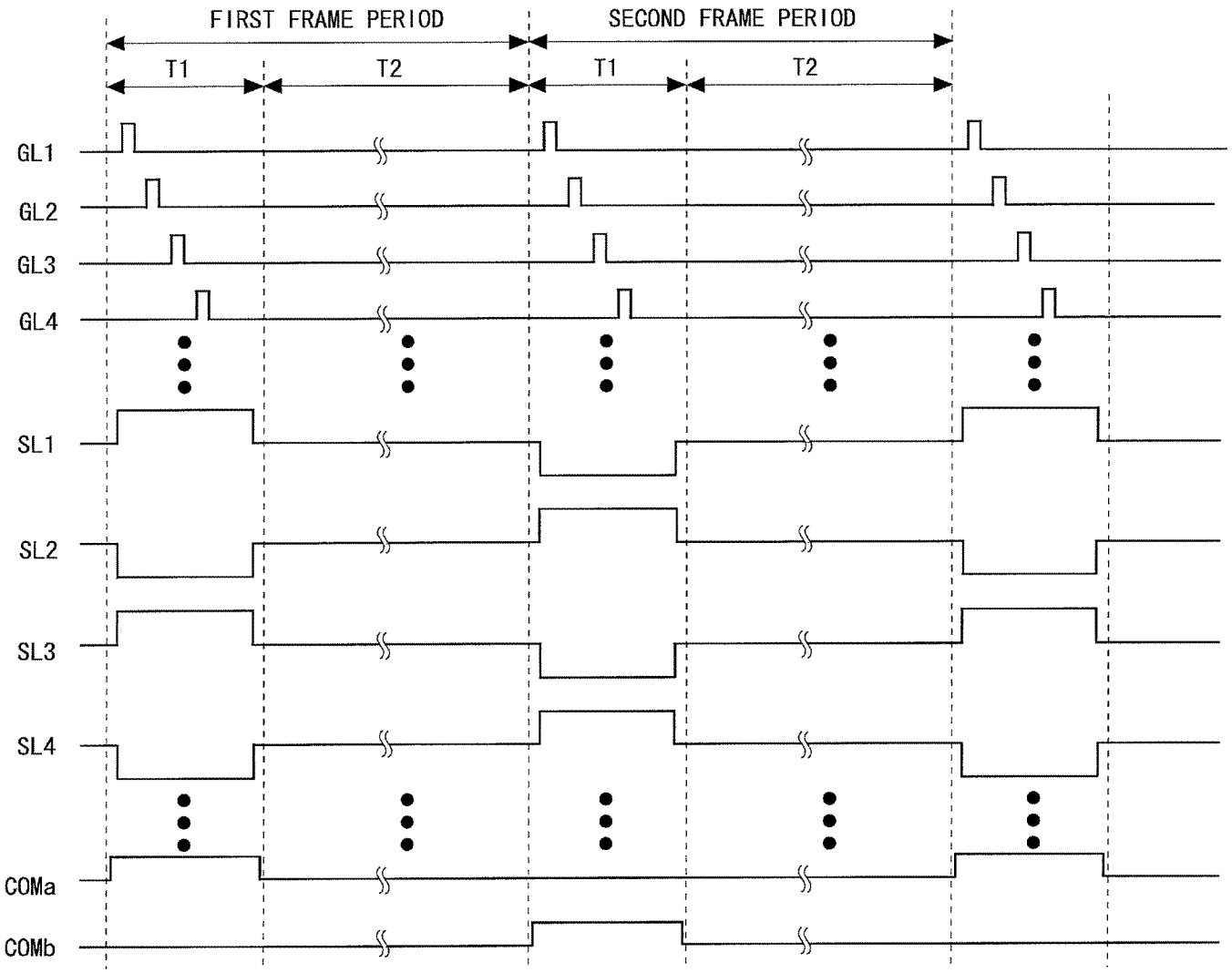
FIG. 14 is a timing chart for allowing the liquid crystal panel shown in FIG. 12 to perform column-reversal driving.

FIG. 14 is a timing chart for allowing the liquid crystal panel 60 shown in FIG. 12 to perform column-reversal driving. FIG. 15(*a*) is a diagram showing the locations of positive polarity pixels and negative polarity pixels for when the liquid crystal panel 60 shown in FIG. 12 performs column-reversal driving during odd-numbered frame periods, and FIG. 15(*b*) is a diagram showing the locations of positive polarity pixels and negative polarity pixels for when the liquid crystal panel 60 shown in FIG. 12 performs column-reversal driving during even-numbered frame periods.

As shown in FIG. 14, in the present embodiment, too, each frame period includes a write period T1 for writing image signals to the pixel formation portions 70; and a pause period T2 for holding the image signals written to the pixel formation portions 70 during the write period T1 to display an image on the liquid crystal panel 60. Note that the pause period T2 is set to be longer than the write period T1.

First, during a write period T1 of a first frame period, an active scanning signal (high-level scanning signal) is applied in turn to the m scanning signal lines GL1 to GLm. By this, in the pixel formation portions 70 connected to the scanning signal line to which the high-level scanning signal has been applied, the TFTs 75 are placed in an on state. On the other hand, throughout the write period T1, positive image signals are outputted to the odd-numbered data signal lines SL(2*j*-1) (j is an integer of $1 \leq j \leq n$), and negative image signals are outputted to the even-numbered data signal lines SL(2*j*).

Hence, when a high-level scanning signal is provided to the scanning signal line GL1, the TFTs 75 of the pixel formation portions 70 connected to the scanning signal line GL1 are placed in an on state, and positive image signals are written to the pixel formation portions 70 connected to the data signal lines in the odd-numbered columns SL(2*j*-1), and negative image signals are written to the pixel formation portions 70 connected to the data signal lines in the even-numbered columns SL(2*j*). Thereafter, the scanning signal changes from the high level to a low level, and the TFTs 75 of the pixel formation portions 70 connected to the scanning signal line GL1 are placed in an off state.

Then, when a high-level scanning signal is provided to the scanning signal line GL2, the TFTs 75 of the pixel formation portions 70 connected to the scanning signal line GL2 are placed in an on state, and positive image signals are written to the pixel formation portions 70 connected to the data signal lines in the odd-numbered columns SL(2*j*-1), and negative image signals are written to the pixel formation portions 70 connected to the data signal lines in the even-numbered columns SL(2*j*). Thereafter, the scanning signal changes from the high level to a low level, and the TFTs 75 of the pixel formation portions 70 connected to the scanning signal line GL2 are placed in an off state.

Thereafter, likewise, since positive image signals are written to the pixel formation portions 70 connected to the data signal lines in the odd-numbered columns (2*j*-1), the pixel formation portions 70 become positive polarity pixels. In addition, since negative image signals are written to the pixel formation portions 70 connected to the data signal lines in the even-numbered columns (2*j*), the pixel formation portions 70 become negative polarity pixels. As a result, as shown in FIG. 15(*a*), positive polarity pixels and negative polarity pixels are disposed alternately on a column-by-column basis in the liquid crystal panel 60.

At this time, a counter voltage higher than a reference value is applied to the counter electrode drive signal lines COMa connected to the counter electrodes 82 of the pixel formation portions 70 in the odd-numbered columns that become positive polarity pixels. A counter voltage identical to the reference value is applied to the counter electrode drive signal lines COMb connected to the counter electrodes 82 of the pixel formation portions 70 in the even-numbered columns that become negative polarity pixels.

When image signals are written to all of the pixel formation portions 70, a transition from the write period T1 to a pause period T2 is made. During the pause period T2, all of the scanning signals applied to the scanning signal lines GL1 to GLm go to a low level. Image signals applied to the data signal lines SL1 to SLn go to an intermediate level. Immediately before transitioning to the pause period T2, the counter voltage applied to the counter electrode drive signal lines in the odd-numbered columns COMa is brought back to the original reference value from the voltage higher than the reference value. Note that the counter voltage applied to the counter electrode drive signal lines in the even-numbered columns COMb has the same reference value as that for the write period T1.

Then, during a write period T1 of a second frame period, as with the write period T1 of the first frame period, a high-level scanning signal is applied in turn to the m scanning signal lines GL1 to GLm. In addition, unlike the write period T1 of the first frame period, throughout the write period T1, negative image signals are provided to the data signal lines in the odd-numbered columns SL(2*j*-1) and positive image signals are provided to the data signal lines in the even-numbered columns SL(2*j*). Hence, when a high-level scanning signal is provided to the scanning signal line in the first row GL1, negative image signals are provided to the pixel formation portions 70 connected to the data signal lines in the odd-numbered columns SL(2*j*-1), and positive image signals are provided to the pixel formation portions 70 connected to the data signal lines in the even-numbered columns SL(2*j*).

When a high-level scanning signal is provided to the scanning signal line in the second row GL2, too, negative image signals are written to the pixel formation portions 70 connected to the data signal lines in the odd-numbered columns SL(2*j*-1), and positive image signals are written to the pixel formation portions 70 connected to the data signal lines in the even-numbered columns SL(2*j*). Thereafter, likewise, since negative image signals are written to the pixel formation portions 70 connected to the data signal lines in the odd-numbered columns SL(2*j*-1), the pixel formation portions 70 become negative polarity pixels. In addition, since positive image signals are written to the pixel formation portions 70 connected to the data signal lines in the even-numbered columns SL(2*j*), the pixel formation portions 70 become positive polarity pixels. As a result, as shown in FIG. 15(*b*), negative polarity pixels and positive polarity pixels are disposed alternately on a column-by-column basis in the liquid crystal panel 60.

At this time, a counter voltage higher than the reference value is applied to the counter electrode drive signal lines COMb connected to the counter electrodes 82 of the pixel formation portions 70 in the even-numbered columns that become positive polarity pixels. A counter voltage identical to the reference value is applied to the counter electrode drive signal lines COMa connected to the counter electrodes 82 of the pixel formation portions 70 in the odd-numbered columns that become negative polarity pixels.

When image signals are written to all of the pixel formation portions 70, a transition from the write period T1 to a pause period T2 is made. Immediately before transitioning to the pause period T2, the counter voltage applied to the counter electrode drive signal lines in the even-numbered columns COMb is brought back to the original reference value from the voltage higher than the reference value. Note that the counter voltage applied to the counter electrode drive signal lines in the odd-numbered columns COMa has the same reference value as that for the write period T1.

Thereafter, likewise, during a write period T1 of an odd-numbered frame period, the pixel formation portions 70 connected to the data signal lines in the odd-numbered columns SL(2*j*-1) become positive polarity pixels. However, since a voltage higher than the reference value is applied to the counter electrode drive signal lines COMa, a voltage applied to the liquid crystal layer of the positive polarity pixels decreases. By this, the change in luminance over time decreases. During a write period T1 of an even-numbered frame period, the pixel formation portions 70 connected to the data signal lines in the even-numbered columns SL(2*j*) become positive polarity pixels. However, since a voltage higher than the reference value is applied to the counter electrode drive signal lines COMb, a voltage applied to the liquid crystal layer decreases. By this, the change in luminance over time decreases.

The effects obtained in the present embodiment are the same as those obtained in the first embodiment and thus a description thereof is omitted. In a liquid crystal display device of a column-reversal driving scheme, too, the occurrence of flicker is restrained.

4. Third Embodiment

A liquid crystal display device of a dot-reversal driving scheme according to a third embodiment of the present invention will be described. A block diagram showing an overall configuration of a liquid crystal display device according to the present embodiment is the same as that shown in FIG. 5, and thus, a block diagram showing the overall configuration and a description thereof are omitted.

4.1 Liquid Crystal Panel

Figure 16:
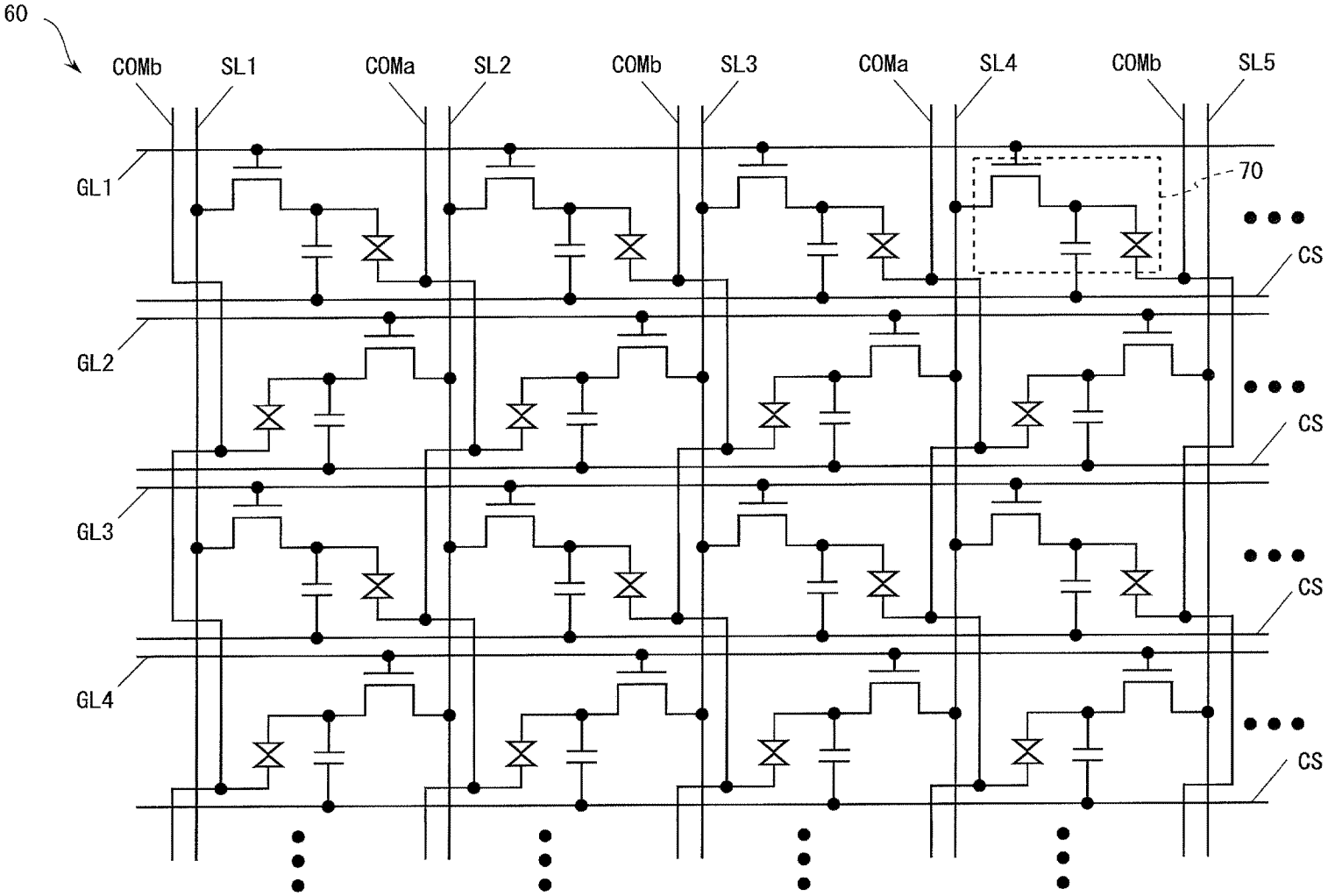
FIG. 16 is a diagram showing a connection relationship between a plurality of pixel formation portions disposed in a liquid crystal panel used for dot-reversal driving in a liquid crystal display device according to a third embodiment of the present invention.

FIG. 16 is a diagram showing a connection relationship between a plurality of pixel formation portions 70 in a liquid crystal panel 60 used for dot-reversal driving. Note that the disposition of scanning signal lines GL1 to GLm and auxiliary capacitance electrode drive signal lines CS is the same as that for the case shown in FIG. 8, and thus, a description thereof is omitted.

In data signal lines SL1 to SLn are disposed so as to intersect the scanning signal lines GL1 to GLm. In addition, n counter electrode drive signal lines are disposed so as to extend in the same direction as the data signal lines SL1 to SLn while intersecting the data signal lines SL1 to SLn row by row. Specifically, each counter electrode drive signal line extends along the data signal lines while alternately connecting counter electrodes 82 included in pixel formation portions 70 in the odd-numbered rows that belong to the same column, to counter electrodes 82 included in pixel formation portions 70 in the even-numbered rows that belong to a column adjacent to the column. As will be described later, during a write period T1, different counter voltages are provided to the counter electrode drive signal lines in the odd-numbered columns and the counter electrode drive signal lines in the even-numbered columns of the n counter electrode drive signal lines. Hence, in the present embodiment, too, the counter electrode drive signal lines in the odd-numbered columns are referred to as COMa and the counter electrode drive signal lines in the even-numbered columns are referred to as COMb. The counter electrode drive signal lines COMa are connected to one another, becoming a single counter electrode drive signal line COMA, and the counter electrode drive signal lines COMb are connected to one another, becoming a single counter electrode drive signal line COMB. The counter electrode drive signal lines COMA and COMB are connected to a counter electrode drive circuit 40. The counter electrode drive circuit 40 can apply, through the counter electrode drive signal lines COMA and COMB, different counter voltages to a counter electrode 82 of a pixel formation portion 70 and counter electrodes 82 of pixel formation portions 70 adjacent in up, down, left, and right directions to the pixel formation portion 70.

Figure 17:
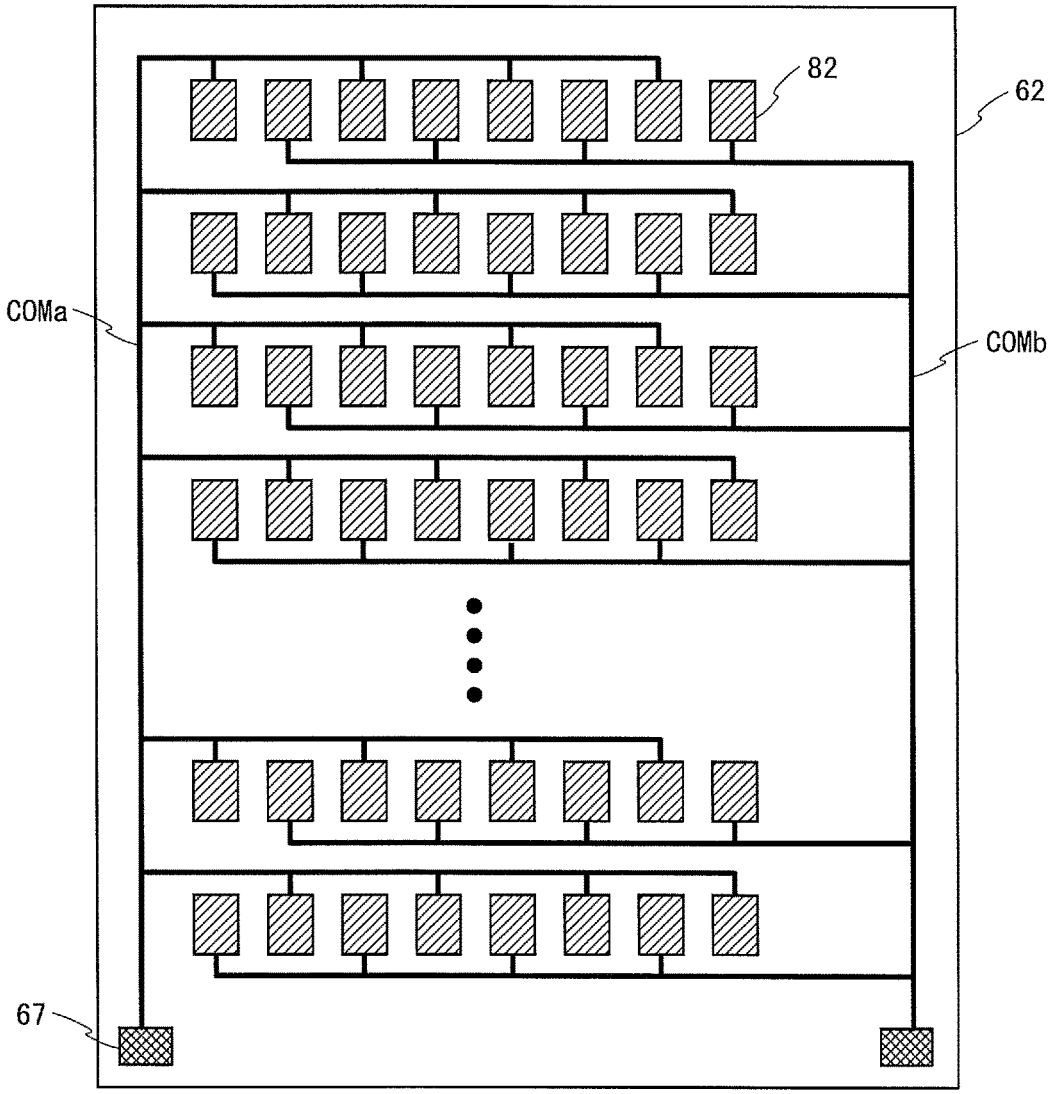
FIG. 17 is a diagram showing disposition of counter electrodes for performing dot-reversal driving in the liquid crystal display device according to the third embodiment of the present invention.

FIG. 17 is a diagram showing disposition of the counter electrodes 82 for performing dot-reversal driving. As shown in FIG. 17, m×n small rectangular counter electrodes 82 are formed at locations on a counter substrate 62 corresponding to the locations of the pixel formation portions on an array substrate 61. The counter electrode drive signal lines COMa are connected to the counter electrodes 82 located in the odd-numbered rows and odd-numbered columns and in the even-numbered rows and even-numbered columns, and the counter electrode drive signal lines COMb are connected to the counter electrodes 82 located in the odd-numbered rows and even-numbered columns and in the even-numbered rows and odd-numbered columns. In addition, the counter electrode drive signal lines COMa and COMb are connected to the array substrate 61 by electrode transfer materials 67. Hence, two different types of counter voltages in a row direction and a column direction can be applied in turn to the counter electrodes 82 disposed in a matrix form. As a result, to a given counter electrode 82 is provided a counter voltage different than a counter voltage provided to counter electrodes 82 adjacent in the row and column directions to the counter electrode 82.

4.2 Drive Method

Figure 18:
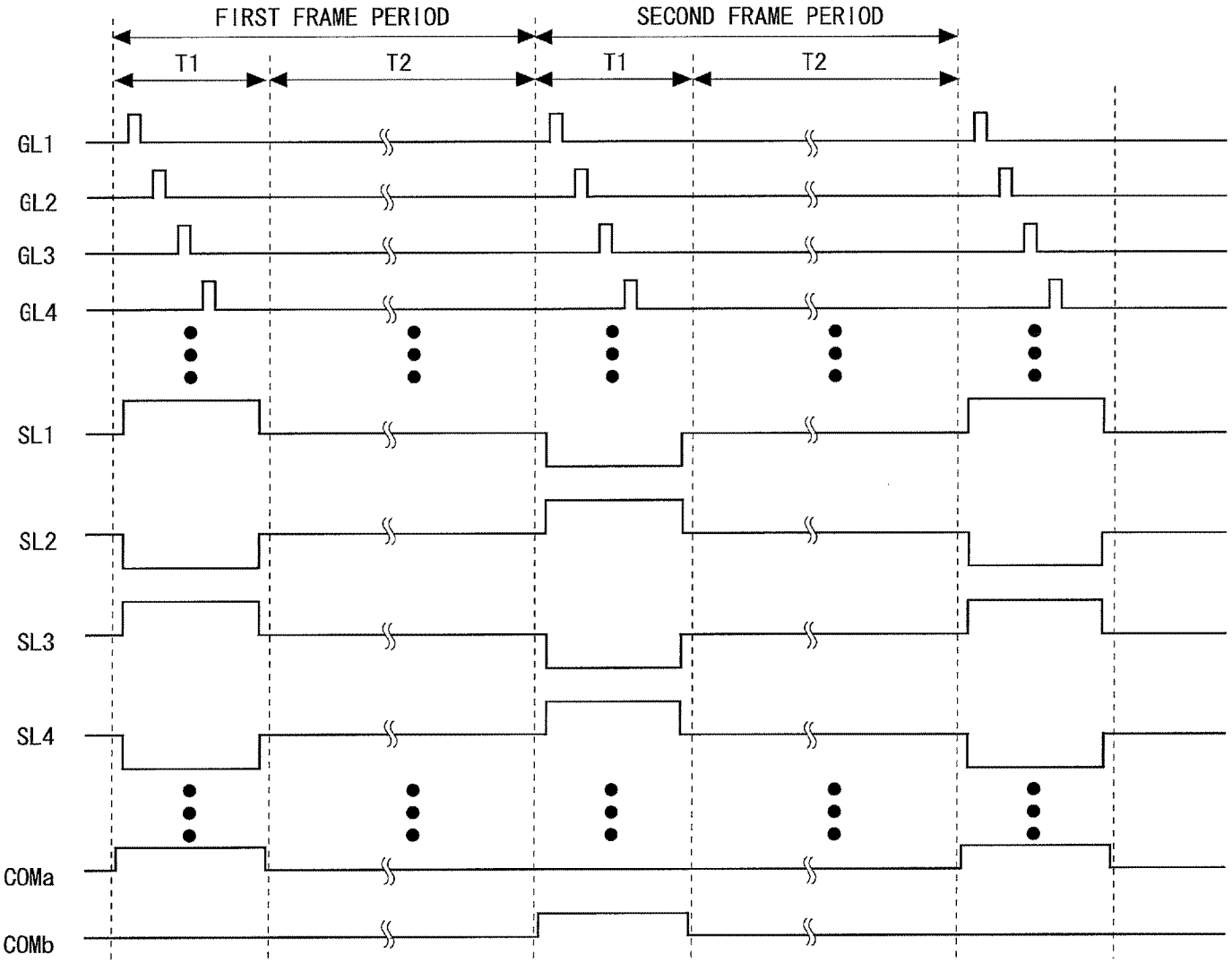
FIG. 18 is a timing chart for allowing the liquid crystal panel shown in FIG. 16 to perform dot-reversal driving.

FIG. 18 is a timing chart for allowing the liquid crystal panel 60 shown in FIG. 16 to perform dot-reversal driving. FIG. 19(*a*) is a diagram showing the locations of positive polarity pixels and negative polarity pixels for when the liquid crystal panel 60 shown in FIG. 16 performs dot-reversal driving during odd-numbered frame periods, and FIG. 19(*b*) is a diagram showing the locations of positive polarity pixels and negative polarity pixels for when the liquid crystal panel 60 shown in FIG. 16 performs dot-reversal driving during even-numbered frame periods.

As shown in FIG. 18, in the present embodiment, too, each frame period includes a write period T1 for writing image signals to the pixel formation portions 70; and a pause period T2 for holding the image signals written to the pixel formation portions 70 during the write period T1 to display an image on the liquid crystal panel 60. Note that the pause period T2 is set to be longer than the write period T1.

Scanning signals provided to the scanning signal lines GL1 to GLm, image signals provided to the data signal lines SL1 to SLn, and counter voltages provided to the counter electrode drive signal lines COMa and COMb during the write period T1 are the same as those for the case of the second embodiment, and thus, a description thereof is omitted. However, as described above, since the method of connecting the data signal lines to the pixel formation portions 70 differs from that for the case of the second embodiment, the polarities of image signals provided to the pixel formation portions 70 differ. By this, the disposition of positive polarity pixels and negative polarity pixels differs from that for the case of the second embodiment.

First, during a write period T1 of a first frame period, a high-level scanning signal is applied to the scanning signal line GL1. By this, the TFTs 75 of the pixel formation portions 70 in the first row connected to the scanning signal line GL1 are placed in an on state, and positive image signals are written to the pixel formation portions 70 in the odd-numbered columns through the data signal lines in the odd-numbered columns SL(2*j*-1). In addition, negative image signals are written to the pixel formation portions 70 in the even-numbered columns through the data signal lines in the even-numbered columns SL(2*j*). Then, the scanning signal changes from the high level to a low level, and the TFTs 75 of the pixel formation portions 70 in the first row connected to the scanning signal line GL1 are placed in an off state.

Then, a high-level scanning signal is applied to the scanning signal line GL2. By this, the TFTs 75 of the pixel formation portions 70 in the second row connected to the scanning signal line GL2 are placed in an on state, and positive image signals are written to the pixel formation portions 70 in the even-numbered columns through the data signal lines in the odd-numbered columns SL(2*j*-1). In addition, negative image signals are written to the pixel formation portions 70 in the odd-numbered columns through the data signal lines in the even-numbered columns SL(2*j*). Then, the scanning signal changes from the high level to a low level, and the TFTs 75 of the pixel formation portions 70 in the second row connected to the scanning signal line GL2 are placed in an off state.

Thereafter, likewise, when a high-level scanning signal is applied to a scanning signal line in an odd-numbered row GL(2*i*-1), the TFTs 75 of the pixel formation portions 70 connected to the scanning signal line GL(2*i*-1) are placed in an on state, and positive image signals are written to the pixel formation portions 70 in the odd-numbered columns through the data signal lines in the odd-numbered columns SL(2*j*-1). By this, the pixel formation portions 70 in the odd-numbered columns become positive polarity pixels. In addition, negative image signals are written to the pixel formation portions 70 in the even-numbered columns through the data signal lines in the even-numbered columns SL(2*j*). By this, the pixel formation portions 70 in the even-numbered columns become negative polarity pixels.

When a high-level scanning signal is applied to a scanning signal line in an even-numbered row GL(2*i*), the TFTs 75 of the pixel formation portions 70 connected to the scanning signal line GL(2*i*) are placed in an on state, and positive image signals are written to the pixel formation portions 70 in the even-numbered columns through the data signal lines in the odd-numbered columns SL(2*j*-1). By this, the pixel formation portions 70 in the even-numbered columns become positive polarity pixels. In addition, negative image signals are written to the pixel formation portions 70 in the odd-numbered columns through the data signal lines in the even-numbered columns SL(2*j*). By this, the pixel formation portions 70 in the odd-numbered columns become negative polarity pixels. As a result, as shown in FIG. 19(*a*), positive polarity pixels and negative polarity pixels are disposed alternately on a row-by-row and column-by-column basis in the liquid crystal panel 60.

At this time, a counter voltage higher than a reference value is applied to the counter electrode drive signal lines COMa connected to the counter electrodes 82 of the pixel formation portions 70 that become positive polarity pixels. A counter voltage identical to the reference value is applied to the counter electrode drive signal lines COMb connected to the counter electrodes 82 of the pixel formation portions 70 that become negative polarity pixels.

When image signals are written to all of the pixel formation portions 70, a transition from the write period T1 to a pause period T2 is made. During the pause period T2, all of the scanning signals applied to the scanning signal lines GL1 to GLm go to a low level. Image signals applied to the data signal lines SL1 to SLn go to an intermediate level. Immediately before transitioning to the pause period T2, the counter voltage applied to the counter electrode drive signal lines COMa is brought back to the original reference value from the voltage higher than the reference value. Note that the counter voltage applied to the counter electrode drive signal lines COMb has the same reference value as that for the write period T1.

As such, during the odd-numbered frame periods, a counter voltage higher than the reference value is applied to the counter electrode drive signal lines COMa connected to the counter electrodes 82 of the pixel formation portions 70 that become positive polarity pixels, by which a voltage applied to the liquid crystal layer of the positive polarity pixels emerging in a staggered manner in the row and column directions decreases. By this, the change in luminance over time during the odd-numbered frame periods decreases.

Then, during a write period T1 of a second frame period, as with the write period T1 of the first frame period, a high-level scanning signal is applied in turn to the m scanning signal lines GL1 to GLm. In addition, unlike the write period T1 of the first frame period, throughout the write period T1, negative image signals are provided to the data signal lines in the odd-numbered columns SL(2*j*-1) and positive image signals are provided to the data signal lines in the even-numbered columns SL(2*j*).

When a high-level scanning signal is provided to the scanning signal line in the first row GL1, the TFTs 75 of the pixel formation portions 70 in the first row connected to the scanning signal line GL1 are placed in an on state, and negative image signals are written to the pixel formation portions 70 in the odd-numbered columns through the data signal lines in the odd-numbered columns SL(2*j*-1). In addition, positive image signals are written to the pixel formation portions 70 in the even-numbered columns through the data signal lines in the even-numbered columns SL(2*j*). Then, the scanning signal changes from the high level to a low level, and the TFTs 75 of the pixel formation portions 70 in the first row connected to the scanning signal line GL1 are placed in an off state.

Then, a high-level scanning signal is applied to the scanning signal line GL2. By this, the TFTs 75 of the pixel formation portions 70 in the second row connected to the scanning signal line GL2 are placed in an on state, and negative image signals are written to the pixel formation portions 70 in the even-numbered columns through the data signal lines in the odd-numbered columns SL(2*j*-1). In addition, positive image signals are written to the pixel formation portions 70 in the odd-numbered columns through the data signal lines in the even-numbered columns SL(2*j*). Then, the scanning signal changes from the high level to a low level, and the TFTs 75 of the pixel formation portions 70 in the second row connected to the scanning signal line GL2 are placed in an off state.

Thereafter, likewise, when a high-level scanning signal is applied to a scanning signal line in an odd-numbered row GL(2*i*-1), the TFTs 75 of the pixel formation portions 70 connected to the scanning signal line GL(2*i*-1) are placed in an on state, and negative image signals are written to the pixel formation portions 70 in the odd-numbered columns through the data signal lines in the odd-numbered columns SL(2*j*-1). By this, the pixel formation portions 70 in the odd-numbered columns become negative polarity pixels. In addition, positive image signals are written to the pixel formation portions 70 in the even-numbered columns through the data signal lines in the even-numbered columns SL(2*j*). By this, the pixel formation portions 70 in the even-numbered columns become positive polarity pixels.

When a high-level scanning signal is applied to a scanning signal line in an even-numbered row GL(2*i*), the TFTs 75 of the pixel formation portions 70 connected to the scanning signal line GL(2*i*) are placed in an on state, and negative image signals are written to the pixel formation portions 70 in the even-numbered columns through the data signal lines in the odd-numbered columns SL(2*j*-1). By this, the pixel formation portions 70 in the even-numbered columns become negative polarity pixels. In addition, positive image signals are written to the pixel formation portions 70 in the odd-numbered columns through the data signal lines in the even-numbered columns SL(2*j*). By this, the pixel formation portions 70 in the odd-numbered columns become positive polarity pixels. As a result, as shown in FIG. 19(*b*), negative polarity pixels and positive polarity pixels are disposed alternately on a row-by-row and column-by-column basis in the liquid crystal panel 60.

At this time, a counter voltage higher than the reference value is applied to the counter electrode drive signal lines COMb connected to the counter electrodes 82 of the pixel formation portions 70 that become positive polarity pixels. A counter voltage identical to the reference value is applied to the counter electrode drive signal lines COMa connected to the counter electrodes 82 of the pixel formation portions 70 that become negative polarity pixels.

When image signals are written to all of the pixel formation portions 70, a transition from the write period T1 to a pause period T2 is made. During the pause period T2, all of the scanning signals applied to the scanning signal lines GL1 to GLm go to a low level. Image signals applied to the data signal lines SL1 to SLn go to an intermediate level. Immediately before transitioning from the write period T1 to the pause period T2, the counter voltage applied to the counter electrode drive signal lines COMb is brought back to the original reference value from the voltage higher than the reference value. Note that the counter voltage applied to the counter electrode drive signal lines COMa has the same reference value as that for the write period T1.

As such, during the even-numbered frame periods, a counter voltage higher than the reference value is applied to the counter electrode drive signal lines COMb connected to the counter electrodes 82 of the pixel formation portions 70 that become positive polarity pixels, by which a voltage applied to the liquid crystal layer of the positive polarity pixels emerging in a staggered manner in the row and column directions decreases. By this, during the even-numbered frame periods, too, the change in luminance over time decreases.

The effects obtained in the present embodiment are the same as those obtained in the first embodiment and thus a description thereof is omitted. In a liquid crystal display device of a dot-reversal driving scheme, too, the occurrence of flicker is restrained.

5. Others

Liquid crystal display devices of the above-described embodiments can be mounted on, for example, mobile phones, pocket game machines, PDAs (personal digital assistants), portable televisions, remote controls, notebook personal computers, and other portable terminals. These portable devices are often driven by batteries. By mounting a liquid crystal display device capable of achieving a reduction in power consumption while maintaining excellent display quality with no flicker, long hours driving is possible.

In addition, in the above-described embodiments, liquid crystal display devices are described. However, the present invention is also applicable to a display device including pixel electrodes and a counter electrode facing the pixel electrodes, e.g., an organic EL display device.

INDUSTRIAL APPLICABILITY

The present invention can be applied to a display device that performs pause driving and a method of driving the display device.

DESCRIPTION OF REFERENCE CHARACTERS

20: SCANNING SIGNAL LINE DRIVE CIRCUIT
30: DATA SIGNAL LINE DRIVE CIRCUIT
40: COUNTER ELECTRODE DRIVE CIRCUIT
70: PIXEL FORMATION PORTION
75: THIN FILM TRANSISTOR (TFT) (SWITCHING ELEMENT)
80: LIQUID CRYSTAL CAPACITANCE (HOLDING CAPACITANCE)

81: PIXEL ELECTRODE
82: COUNTER ELECTRODE
GL1 to GLm: SCANNING SIGNAL LINE
SL1 to SLm: DATA SIGNAL LINE
COMa and COMb: COUNTER ELECTRODE DRIVE SIGNAL LINE

The invention claimed is:

1. A method of driving a display device comprising:

a plurality of scanning signal lines and a plurality of data signal lines intersecting the plurality of scanning signal lines;

a plurality of pixel formation portions disposed in a matrix form at respective intersections of the plurality of scanning signal lines and the plurality of data signal lines;

a scanning signal line drive circuit that selects in turn the plurality of scanning signal lines; and a data signal line drive circuit that applies signal voltages of image signals to the plurality of data signal lines to write the signal voltages to pixel formation portions connected to a selected scanning signal line, wherein each of the pixel formation portions includes: a pixel electrode to which a corresponding one of the signal voltages is applied; a counter electrode to which a counter voltage is applied, the counter electrode being provided so as to face the pixel electrode; a switching element that provides the signal voltage to the pixel electrode connected to the selected scanning signal line; and a holding capacitance that holds a drive voltage determined by the signal voltage applied to the pixel electrode and the counter voltage applied to the counter electrode, the signal voltage includes a positive signal voltage and a negative signal voltage, the method comprising the steps of:

providing a write period during which all of the scanning signal lines are selected in turn and one of the positive signal voltage and the negative signal voltage is applied to the pixel electrodes of all of the pixel formation portions, and a pause period during which all of the scanning signal lines are placed in a non-selected state, the pause period following the write period and being longer than the write period, during the write period, applying a first voltage to the counter electrodes of the pixel formation portions to which the positive signal voltage is to be written, during the pause period, applying a second voltage to the counter electrodes of the pixel formation portions to which the positive signal voltage has been written, the second voltage having a value lower than the first voltage, and during both the write period and the pause period, applying the second voltage to the counter electrodes of the pixel formation portions to which the negative signal voltage is to be written.

2. The method of driving a display device according to claim 1, further comprising first and second counter electrode drive signal lines for respectively applying the first and second voltages to the counter electrodes of the pixel formation portions, wherein the first voltage is applied to counter electrodes of some of the plurality of pixel formation portions through the first counter electrode drive signal line, and the second voltage is applied to counter electrodes of other pixel formation portions through the second counter electrode drive signal line.

3. The method of driving a display device according to claim 2, wherein the counter electrodes are connected to each other by one of the first and second counter electrode drive signal lines on a per plurality of pixel formation portions basis, the plurality of pixel formation portions being formed in parallel to the scanning signal lines and being disposed in a same direction as the scanning signal lines.

4. The method of driving a display device according to claim 2, wherein the counter electrodes are connected to each other by one of the first and second counter electrode drive signal lines on a per plurality of pixel formation portions basis, the plurality of pixel formation portions being formed in parallel to the data signal lines and being disposed in a same direction as the data signal lines.

5. The method of driving a display device according to claim 2, wherein counter electrodes included in one of a group of pixel formation portions disposed in an odd-numbered row and an odd-numbered column and in an even-numbered row and an even-numbered column and a group of pixel formation portions disposed in an odd-numbered row and an even-numbered column and in an even-numbered row and an odd-numbered column among the pixel formation portions disposed in a matrix form are connected to each other by the first counter electrode drive signal line, and counter electrodes included in another group of pixel formation portions are connected to each other by the second counter electrode drive signal line.

6. The method of driving a display device according to claim 1, wherein the switching element is a thin film transistor using an oxide semiconductor as a channel layer.

7. The method of driving a display device according to claim 1, wherein the switching element is a thin film transistor using polycrystalline silicon as a channel layer.

8. The method of driving a display device according to claim 1, wherein the switching element is a thin film transistor using amorphous silicon as a channel layer.

9. The method of driving a display device according to claim 1, wherein one frame period including a set of the write period and the pause period is a period longer than 1/60 seconds.

10. A display device comprising a counter electrode drive circuit that outputs the first and second voltages to the first and second counter electrode drive signal lines, respectively, to perform the method of driving a display device according to claim 1.

11. A portable device comprising the display device according to claim 10 mounted thereon.

* * * * *